US009269361B2

(12) United States Patent
Ragot et al.

(10) Patent No.: US 9,269,361 B2
(45) Date of Patent: Feb. 23, 2016

(54) STEREO PARAMETRIC CODING/DECODING FOR CHANNELS IN PHASE OPPOSITION

(75) Inventors: Stéphane Ragot, Lannion (FR); Thi Minh Nguyet Hoang, Sundbyberg (SE)

(73) Assignee: FRANCE TELECOM, Paris (FR)

( * ) Notice: Subject to any disclaimer, the term of this patent is extended or adjusted under 35 U.S.C. 154(b) by 262 days.

(21) Appl. No.: 13/880,885

(22) PCT Filed: Oct. 18, 2011

(86) PCT No.: PCT/FR2011/052429
§ 371 (c)(1),
(2), (4) Date: Apr. 22, 2013

(87) PCT Pub. No.: WO2012/052676
PCT Pub. Date: Apr. 26, 2012

(65) Prior Publication Data

US 2013/0262130 A1 Oct. 3, 2013

(30) Foreign Application Priority Data

Oct. 22, 2010 (FR) ..... 10 58687

(51) Int. Cl.
*G10L 19/008* (2013.01)

(52) U.S. Cl.
CPC ..... *G10L 19/008* (2013.01)

(58) Field of Classification Search
CPC ..... G10L 19/008
USPC ..... 704/500
See application file for complete search history.

(56) References Cited

U.S. PATENT DOCUMENTS 7,965,848 B2 * 6/2011 Villemoes ..... H04S 3/00 381/22

(Continued)

FOREIGN PATENT DOCUMENTS

WO WO 2010019265 A1 * 2/2010 ..... G10L 19/008

OTHER PUBLICATIONS

Schijers et al, "Advances in Parametric Coding for High-Quality Audio," Audio Engineering Society, Convention Paper 5852, Mar. 22-25, 2003.*

Briand et al, "Parametric Representation of Multichannel Audio Based on Pricipal Component Analysis," Audio Engineering Society, Convention Paper 6813, May 20-23, 2006.*

(Continued)

*Primary Examiner* — Oluwadamilola M Ogunbiyi
(74) *Attorney, Agent, or Firm* — David D. Brush; Westman, Champlin & Koehler, P.A.

(57) ABSTRACT

A method and apparatus for the parametric encoding of a stereo digital-audio signal. The method includes encoding a mono signal produced by downmixing applied to the stereo signal and encoding spatialization information of the stereo signal. Downmixing includes determining, for a predetermined set of frequency sub-bands, a phase difference between two stereo channels; obtaining an intermediate channel by rotating a first predetermined channel of the stereo signal through an angle obtained by reducing the phase difference; determining the phase of the mono signal from the phase of the signal that is the sum of the intermediate channel and the second stereo signal, and from a phase difference between, on the one hand, the signal that is the sum of the intermediate channel and the second channel and, on the other hand, the second channel of the stereo signal. Also provided are a decoding method, an encoder and a decoder.

15 Claims, 13 Drawing Sheets

(56) References Cited

U.S. PATENT DOCUMENTS

| | | | | |
|---|---|---|---|---|
| 8,538,762 | B2 * | 9/2013 | Moon | G10L 19/008 704/500 |
| 2005/0078832 | A1 * | 4/2005 | Van De Par et al. | G10L 19/08 381/17 |
| 2006/0233379 | A1 * | 10/2006 | Villemoes | G10L 19/008 381/23 |
| 2008/0253576 | A1 * | 10/2008 | Choo | G10L 19/008 381/10 |
| 2009/0210236 | A1 * | 8/2009 | Moon | G10L 19/008 704/500 |
| 2010/0054482 | A1 * | 3/2010 | Johnston | H04S 1/002 381/17 |
| 2010/0246832 | A1 * | 9/2010 | Villemoes | G10L 19/008 381/17 |
| 2011/0173005 | A1 * | 7/2011 | Hilpert | G10L 19/008 704/500 |
| 2012/0020499 | A1 * | 1/2012 | Neusinger | G10L 19/008 381/119 |

OTHER PUBLICATIONS

Kim et al, "Enhanced Stereo Coding with phase parameters for MPEG Unified Speech and Audio Coding," Audio Engineering Society, Convention Paper 7875, Oct. 9-12, 2009.*

International Search Report and Written Opinion dated Dec. 6, 2011 for corresponding International Application No. PCT/FR2011/052429, filed Oct. 18, 2011.

Thi Minh Nguyet Hoang et al., "Parametric Stereo Extension of ITU-T G.722 based on a new Downmixing Scheme", 2010 IEEE International Workshop on Multimedia Signal Processing (MMSP '10), Saint Malo, France, Oct. 4-6, 2010, IEEE, IEEE, Piscataway, USA, Oct. 4, 2010, pp. 188-193, XP031830580.

Breebart et al., "Parametric Coding of Stereo Audio" EURASIP Journal on Applied Signal Processing 2005:9, 1305-1322, 2005.

English translation of the Written Opinion of the International Searching Authority dated Apr. 22, 2013 for corresponding International Application No. PCT/FR011/052429, filed Oct. 18, 2011.

* cited by examiner

STEREO PARAMETRIC CODING/DECODING FOR CHANNELS IN PHASE OPPOSITION

CROSS-REFERENCE TO RELATED APPLICATIONS

This Application is a Section 371 National Stage Application of International Application No. PCT/FR2011/052429, filed Oct. 18, 2011, which is incorporated by reference in its entirety and published as WO 2012/052676 on Apr. 26, 2012, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The present invention relates to the field of the coding/decoding of digital signals.

The coding and the decoding according to the invention is notably adapted to the transmission and/or the storage of digital signals such as audio frequency signals (speech, music, etc.).

More particularly, the present invention relates to the parametric coding/decoding of multichannel audio signals, notably of stereophonic signals hereinafter referred to as stereo signals.

BACKGROUND OF THE DISCLOSURE

This type of coding/decoding is based on the extraction of spatial information parameters so that, upon decoding, these spatial characteristics may be reproduced for the listener, in order to recreate the same spatial image as in the original signal.

Such a technique for parametric coding/decoding is for example described in the document by J. Breebaart, S. van de Par, A. Kohlrausch, E. Schuijers, entitled "Parametric Coding of Stereo Audio" in EURASIP Journal on Applied Signal Processing 2005:9, 1305-1322. This example is reconsidered with reference to FIGS. 1 and 2 respectively describing a parametric stereo coder and decoder.

Thus, FIG. 1 describes a coder receiving two audio channels, a left channel (denoted L for Left in English) and a right channel (denoted R for Right in English).

The time-domain channels L(n) and R(n), where n is the integer index of the samples, are processed by the blocks 101, 102, 103 and 104, respectively, which perform a fast Fourier analysis. The transformed signals L[j] and R[j], where j is the integer index of the frequency coefficients, are thus obtained.

The block 105 performs a channel reduction processing, or "downmix" in English, so as to obtain in the frequency domain, starting from the left and right signals, a monophonic signal hereinafter referred to as 'mono signal' which here is a sum signal.

An extraction of spatial information parameters is also carried out in the block 105. The extracted parameters are as follows.

The parameters ICLD (for "Inter-Channel Level Difference" in English), also referred to as 'inter-channel intensity differences', characterize the energy ratios by frequency sub-band between the left and right channels. These parameters allow sound sources to be positioned in the stereo horizontal plane by "panning". They are defined in dB by the following formula:

$$ICLD[k] = 10.\log_{10}\left(\frac{\sum_{j=B[k]}^{B[k+1]-1} L[j]\cdot L^*[j]}{\sum_{j=B[k]}^{B[k+1]-1} R[j]\cdot R^*[j]}\right)\text{dB} \quad (1)$$

where L[j] and R[j] correspond to the spectral (complex) coefficients of the L and R channels, the values B[k] and B[k+1], for each frequency band of index k, define the division into sub-bands of the discrete spectrum and the symbol * indicates the complex conjugate.

The parameters ICPD (for "Inter-Channel Phase Difference" in English), also referred to as 'phase differences', are defined according to the following equation:

$$\text{ICPD}[k]=\angle\left(\Sigma_{j=B[k]}^{B[k+1]-1} L[j]\cdot R^*[j]\right) \quad (2)$$

where $\angle$ indicates the argument (the phase) of the complex operand.

In an equivalent manner to the ICPD, an ICTD (for "Inter-Channel Time Difference" in English) may also be defined whose definition, known to those skilled in the art, is not recalled here.

In contrast to the parameters ICLD, ICPD and ICTD, which are localization parameters, the parameters ICC (for "Inter-Channel Coherence" in English) on the other hand represent the inter-channel correlation (or coherence) and are associated with the spatial width of the sound sources; their definition is not recalled here, but it is noted in the article by Breebart et al. that the ICC parameters are not needed in the sub-bands reduced to a single frequency coefficient—the reason being that the amplitude and phase differences completely describe the spatialization, in this case "degenerate".

These ICLD, ICPD and ICC parameters are extracted by analyzing the stereo signals, by the block 105. If the ICTD parameters were also coded, these could also be extracted by sub-band from the spectra L[j] and R[j]; however, the extraction of the ICTD parameters is generally simplified by assuming an identical inter-channel time difference for each sub-band and, in this case, these parameters may be extracted from the time-varying channels L(n) and R(n) by means of inter-correlations.

The mono signal M[j] is transformed in the time domain (blocks 106 to 108) after fast Fourier processing (inverse FFT, windowing and addition-overlapping known as OverLap-Add or OLA in English) and a mono coding (block 109) is subsequently carried out. In parallel, the stereo parameters are quantified and coded in the block 110.

Generally speaking, the spectrum of the signals (L[j], R[j]) is divided according to a non-linear frequency scale of the ERB (Equivalent Rectangular Bandwidth) or Bark type, with a number of sub-bands typically going from 20 to 34 for a signal sampled from 16 to 48 kHz. This scale defines the values of B[k] and B[k+1] for each sub-band k. The parameters (ICLD, ICPD, ICC) are coded by scalar quantization potentially followed by an entropic coding and/or by a differential coding. For example, in the article previously cited, the ICLD is coded by a non-uniform quantifier (going from −50 to +50 dB) with differential entropic coding. The non-uniform quantization pitch exploits the fact that the higher the value of the ICLD the lower the auditive sensitivity to the variations in this parameter.

For the coding of the mono signal (block 109), several techniques for quantization with or without memory are possible, for example the coding "Pulse Code Modulation" (PCM), its adaptive version known as "Adaptive Differential Pulse Code Modulation" (ADPCM) or more sophisticated techniques such as the perceptual coding by transform or the coding "Code Excited Linear Prediction" (CELP).

This document is more particularly focused on the recommendation UIT-T G.722 which uses ADPCM coding using codes interleaved in sub-bands.

The input signal of a coder of the G.722 type, in broadband, has a minimum bandwidth of [50-7000 Hz] with a sampling frequency of 16 kHz. This signal is decomposed into two sub-bands [0-4000 Hz] and [4000-8000 Hz] obtained by decomposition of the signal by quadrature mirror filters (or QMF), then each of the sub-bands is coded separately by an ADPCM coder.

The low band is coded by an embedded-codes ADPCM coding over 6, 5 and 4 bits, whereas the high band is coded by an ADPCM coder with 2 bits per sample. The total data rate is 64, 56 or 48 bit/s depending on the number of bits used for the decoding of the low band.

The recommendation G.722 dating from 1988 was first of all used in the ISDN (Integrated Services Digital Network) for audio and videoconference applications. For several years, this coder has been used in applications of HD (High Definition) improved quality voice telephony, or "HD voice" in English, over a fixed IP network.

A quantified signal frame according to the G.722 standard is composed of quantization indices coded over 6, 5 or 4 bits per sample in low band (0-4000 Hz) and 2 bits per sample in high band (4000-8000 Hz). Since the frequency of transmission of the scalar indices is 8 kHz in each sub-band, the data rate is of 64, 56 or 48 kbit/s.

In the decoder 200, with reference to FIG. 2, the mono signal is decoded (block 201), and a de-correlator is used (block 202) to produce two versions $\hat{M}(n)$ and $\hat{M}'(n)$ of the decoded mono signal. This decorrelation allows the spatial width of the mono source $\hat{M}(n)$ to be increased and of thus avoid it being a point-like source. These two signals $\hat{M}(n)$ and $\hat{M}'(n)$ are passed into the frequency domain (blocks 203 to 206) and the decoded stereo parameters (block 207) are used by the stereo synthesis (or shaping) (block 208) to reconstruct the left and right channels in the frequency domain. These channels are finally reconstructed in the time domain (blocks 209 to 214).

Thus, as mentioned for the coder, the block 105 performs a downmix, by combining the stereo channels (left, right) so as to obtain a mono signal which is subsequently coded by a mono coder. The spatial parameters (ICLD, ICPD, ICC, etc.) are extracted from the stereo channels and transmitted in addition to the binary pulse train coming from the mono coder.

Several techniques have been developed for the downmix. This downmix may be carried out in the time or frequency domain. Two types of downmix are generally differentiated:

- Passive downmix, which corresponds to a direct matrixing of the stereo channels in order to combine them into a single signal;
- Active (or adaptive) downmix, which includes a control of the energy and/or of the phase in addition to the combination of the two stereo channels.

The simplest example of passive downmix is given by the following time matrixing:

$$M(n) = \frac{1}{2}(L(n) + R(n)) = \begin{bmatrix} 1/2 & 0 \\ 0 & 1/2 \end{bmatrix} \cdot \begin{bmatrix} L(n) \\ R(n) \end{bmatrix} \tag{3}$$

This type of downmix has however the drawback of not well conserving the energy of the signals after the stereo to mono conversion when the L and R channels are not in phase: in the extreme case where L(n)=−R(n), the mono signal is zero, a situation which is undesirable.

A mechanism for active downmix improving the situation is given by the following equation:

$$M(n) = \gamma(n)\frac{L(n) + R(n)}{2} \tag{4}$$

where γ(n) is a factor which compensates for any potential loss of energy.

However, combining the signals L(n) and R(n) in the time domain does not allow a precise control (with sufficient frequency resolution) of any potential phase differences between L and R channels; when the L and R channels have comparable amplitudes and virtually opposing phases, "fade-out" or "attenuation" phenomena (loss of "energy") on the mono signal may be observed by frequency sub-bands with respect to the stereo channels.

This is the reason that it is often more advantageous in terms of quality to carry out the downmix in the frequency domain, even if this involves calculating time/frequency transforms and leads to a delay and an additional complexity with respect to a time domain downmix.

The preceding active downmix can thus be transposed with the spectra of the left and right channels, in the following manner:

$$M[k] = \gamma[k]\frac{L[k] + R[k]}{2} \tag{5}$$

where k corresponds to the index of a frequency coefficient (Fourier coefficient for example representing a frequency sub-band). The compensation parameter may be set as follows:

$$\gamma[k] = \max\left(2, \sqrt{\frac{|L[k]|^2 + |R[k]|^2}{|L[k] + R[k]|^2/2}}\right) \tag{6}$$

It is thus ensured that the overall energy of the downmix is the sum of the energies of the left and right channels. Here, the factor γ[k] is saturated at an amplification of 6 dB.

The stereo to mono downmix technique in the document by Breebaart et al. cited previously is carried out in the frequency domain. The mono signal M[k] is obtained by a linear combination of the L and R channels according to the equation:

$$M[k]=w_1L[k]+w_2R[k] \tag{7}$$

where $w_1$, $w_2$ are gains with complex values. If $w_1=w_2=0.5$, the mono signal is considered as an average of the two L and R channels. The gains $w_1$, $w_2$ are generally adapted as a function of the short-term signal, in particular for aligning the phases.

One particular case of this frequency-domain downmix technique is provided in the document entitled "A stereo to mono downmixing scheme for MPEG-4 parametric stereo encoder" by Samsudin, E. Kurniawati, N. Boon Poh, F. Sattar, S. George, in IEEE Trans., ICASSP 2006. In this document, the L and R channels are aligned in phase prior to carrying out the channel reduction processing.

More precisely, the phase of the L channel for each frequency sub-band is chosen as the reference phase, the R channel is aligned according to the phase of the L channel for each sub-band by the following formula:

$$R'[k]=e^{i\cdot ICPD[b]}\cdot R[k] \tag{8}$$

where $i=\sqrt{-1}$, R'[k] is the aligned R channel, k is the index of a coefficient in the $b^{th}$ frequency sub-band, ICPD[b] is the inter-channel phase difference in the $b^{th}$ frequency sub-band given by:

$$\mathrm{ICPD}[b]=\angle\left(\Sigma_{k=k_b}^{k=k_{b+1}-1}L[k]\cdot R^*[k]\right) \tag{9}$$

where $k_b$ defines the frequency intervals of the corresponding sub-band and * is the complex conjugate. It is to be noted that when the sub-band with index b is reduced to a frequency coefficient, the following is found:

$$R'[k]=|R[k]|\cdot e^{i\angle L[k]} \tag{10}$$

Finally, the mono signal obtained by the downmixing in the document by Samsudin et al. cited previously is calculated by averaging the L channel and the aligned R channel, according to the following equation:

$$M[k]=\frac{L[k]+R'[k]}{2} \tag{11}$$

The alignment in phase therefore allows the energy to be conserved and the problems of attenuation to be avoided by eliminating the influence of the phase. This downmixing corresponds to the downmixing described in the document by Breebart et al. where:

$$M[k]=w_1L[k]+w_2R[k] \tag{12}$$

with $$w_1=\frac{1}{2}\text{ and }w_2=\frac{ICPD[b]}{2}$$

An ideal conversion of a stereo signal to a mono signal must avoid the problems of attenuation for all the frequency components of the signal.

This downmixing operation is important for parametric stereo coding because the decoded stereo signal is only a spatial shaping of the decoded mono signal.

The technique of downmixing in the frequency domain described previously does indeed conserve the energy level of the stereo signal in the mono signal by aligning the R channel and the L channel prior to performing the processing. This phase alignment allows the situations where the channels are in phase opposition to be avoided.

The method of Samsudin et al. is however based on a total dependency on the downmix processing on the channel (L or R) chosen for setting the phase reference.

In the extreme cases, if the reference channel is zero ("dead" silence) and if the other channel is non-zero, the phase of the mono signal after downmixing becomes constant, and the resulting mono signal will, in general, be of poor quality; similarly, if the reference channel is a random signal (ambient noise, etc.), the phase of the mono signal may become random or be poorly conditioned with, here again, a mono signal that will generally be of poor quality.

An alternative technique for frequency downmixing has been proposed in the document entitled "Parametric stereo extension of ITU-T G.722 based on a new downmixing scheme" by T. M. N Hoang, S. Ragot, B. Kovësi, P. Scalart, Proc. IEEE MMSP, 4-6 Oct. 2010. This document provides a downmixing technique which overcomes drawbacks of the downmixing technique provided by Samsudin et al. According to this document, the mono signal M[k] is calculated from the stereo channels L[k] and R[k] by the following formula:

$$M[k]=|M[k]|\cdot e^{i\angle M[k]}$$

where the amplitude |M[k]| and the phase ∠M[k] for each sub-band are defined by:

$$\begin{cases}|M[k]|=\dfrac{|L[k]|+|R[k]|}{2}\\ \angle M[k]=\angle(L[k]+R[k])\end{cases}$$

The amplitude of M[k] is the average of the amplitudes of the L and R channels. The phase of M[k] is given by the phase of the signal summing the two stereo channels (L+R).

The method of Hoang et al. preserves the energy of the mono signal like the method of Samsudin et al., and it avoids the problem of total dependency on one of the stereo channels (L or R) for the phase calculation ∠M[k]. However, it has a disadvantage when the L and R channels are in virtual phase opposition in certain sub-bands (with as extreme case L=−R). Under these conditions, the resulting mono signal will be of poor quality.

There thus exists a need for a method of coding/decoding which allows channels to be combined while managing the stereo signals in phase opposition or whose phase is poorly conditioned in order to avoid the problems of quality that these signals can create.

SUMMARY

An aspect of the present disclosure provides a method for parametric coding of a stereo digital audio signal comprising a step for coding a mono signal coming from a channel reduction processing applied to the stereo signal and for coding spatialization information of the stereo signal. The method is such that the channel reduction processing comprises the following steps:

- determine, for a predetermined set of frequency sub-bands, a phase difference between two stereo channels;
- obtain an intermediate channel by rotation of a predetermined first channel of the stereo signal, through an angle obtained by reduction of said phase difference;
- determine the phase of the mono signal starting from the phase of the signal summing the intermediate channel and the second stereo signal and from a phase difference between, on the one hand, the signal summing the intermediate channel and the second channel and, on the other hand, the second channel of the stereo signal.

Thus, the channel reduction processing allows both the problems linked to the stereo channels in virtual phase opposition and the problem of potential dependency of the processing on the phase of a reference channel (L or R) to be solved.

Indeed, since this processing comprises a modification of one of the stereo channels by rotation through an angle less than the value of the phase difference of the stereo channels (ICPD), in order to obtain an intermediate channel, it allows an angular interval to be obtained that is adapted to the calculation of a mono signal whose phase (by frequency sub-band) does not depend on a reference channel. Indeed, the channels thus modified are not aligned in phase.

The quality of the mono signal obtained coming from the channel reduction processing is improved as a result, notably in the case where the stereo signals are in phase opposition or close to phase opposition.

The various particular embodiments mentioned hereinafter may be added independently, or in combination with one another, to the steps of the coding method defined hereinabove.

In one particular embodiment, the mono signal is determined according to the following steps:

obtain, by frequency band, an intermediate mono signal from said intermediate channel and from the second channel of the stereo signal;

determine the mono signal by rotation of said intermediate mono signal by the phase difference between the intermediate mono signal and the second channel of the stereo signal.

In this embodiment, the intermediate mono signal has a phase which does not depend on a reference channel owing to the fact that the channels from which it is obtained are not aligned in phase. Moreover, since the channels from which the intermediate mono signal is obtained are not in phase opposition either, even if the original stereo channels are, the problem of lower quality resulting from this is solved.

In one particular embodiment, the intermediate channel is obtained by rotation of the predetermined first channel by half (ICPD[j]/2) of the determined phase difference.

This allows an angular interval to be obtained in which the phase of the mono signal is linear for stereo signals in phase opposition or close to phase opposition.

In order to be adapted to this channel reduction processing, the spatialization information comprises a first information on the amplitude of the stereo channels and a second information on the phase of the stereo channels, the second information comprising, by frequency sub-band, the phase difference defined between the mono signal and a predetermined first stereo channel.

Thus, only the spatialization information useful for the reconstruction of the stereo signal is coded. A low-rate coding is then possible while at the same time allowing the decoder to obtain a stereo signal of high quality.

In one particular embodiment, the phase difference between the mono signal and the predetermined first stereo channel is a function of the phase difference between the intermediate mono signal and the second channel of the stereo signal.

Thus, it is not useful, for the coding of the spatialization information, to determine another phase difference than that already used in the channel reduction processing. This therefore provides a gain in processing capacity and time.

In one variant embodiment, the predetermined first channel is the channel referred to as primary channel whose amplitude is the higher between the channels of the stereo signal.

Thus, the primary channel is determined in the same manner in the coder and in the decoder without exchange of information. This primary channel is used as a reference for the determination of the phase differences useful for the channel reduction processing in the coder or for the synthesis of the stereo signals in the decoder.

In another variant embodiment, for at least one predetermined set of frequency sub-bands, the predetermined first channel is the channel referred to as primary channel for which the amplitude of the locally decoded corresponding channel is the higher between the channels of the stereo signal.

Thus, the determination of the primary channel takes place on values decoded locally to the coding which are therefore identical to those that will be decoded in the decoder.

Similarly, the amplitude of the mono signal is calculated as a function of amplitude values of the locally decoded stereo channels.

The amplitude values thus correspond to the true decoded values and allow a better quality of spatialization to be obtained at the decoding.

In one variant embodiment of all the embodiments adapted to a hierarchical coding, the first information is coded by a first layer of coding and the second information is coded by a second layer of coding.

The present invention also relates to a method for parametric decoding of a stereo digital audio signal comprising a step for decoding a received mono signal, coming from a channel reduction processing applied to the original stereo signal, and for decoding spatialization information of the original stereo signal. The method is such that the spatialization information comprises a first information on the amplitude of the stereo channels and a second information on the phase of the stereo channels, the second information comprising, by frequency sub-band, the phase difference defined between the mono signal and a predetermined first stereo channel. The method also comprises the following steps:

based on the phase difference defined between the mono signal and a predetermined first stereo channel, calculate a phase difference between an intermediate mono channel and the predetermined first channel for a set of frequency sub-bands;

determine an intermediate phase difference between the second channel of the modified stereo signal and an intermediate mono signal from the calculated phase difference and from the decoded first information;

determine the phase difference between the second channel and the mono signal from the intermediate phase difference;

synthesize stereo signals, by frequency coefficient, starting from the decoded mono signal and from the phase differences determined between the mono signal and the stereo channels.

Thus, at the decoding, the spatialization information allows the phase differences adapted for performing the synthesis of the stereo signals to be found.

The signals obtained have an energy that is conserved with respect to the original stereo signals over the whole frequency spectrum, with a high quality even for original signals in phase opposition.

According to one particular embodiment, the predetermined first stereo channel is the channel referred to as primary channel whose amplitude is the higher between the channels of the stereo signal.

This allows the stereo channel used for obtaining an intermediate channel in the coder to be determined in the decoder without transmission of additional information.

In one variant embodiment of all the embodiments, adapted to hierarchical decoding, the first information on the amplitude of the stereo channels is decoded by a first decoding layer and the second information is decoded by a second decoding layer.

The invention also relates to a parametric coder for a stereo digital audio signal comprising a module for coding a mono signal coming from a channel reduction processing module applied to the stereo signal and modules for coding spatialization information of the stereo signal. The coder is such that the channel reduction processing module comprises:

means for determining, for a predetermined set of frequency sub-bands, a phase difference between the two channels of the stereo signal;

means for obtaining an intermediate channel by rotation of a predetermined first channel of the stereo signal, through an angle obtained by reduction of said determined phase difference;

means for determining the phase of the mono signal starting from the phase of the signal summing the intermediate channel and the second stereo signal and from a phase difference between, on the one hand, the signal summing the intermediate channel and the second channel and, on the other hand, the second channel of the stereo signal.

It also relates to a parametric decoder for a digital audio signal of a stereo digital audio signal comprising a module for decoding a received mono signal, coming from a channel reduction processing applied to the original stereo signal and modules for decoding spatialization information of the original stereo signal. The decoder is such that the spatialization information comprises a first information on the amplitude of the stereo channels and a second information on the phase of the stereo channels, the second information comprising, by frequency sub-band, the phase difference defined between the mono signal and a predetermined first stereo channel. The decoder comprises:

means for calculating a phase difference between an intermediate mono channel and the predetermined first channel for a set of frequency sub-bands, starting from the phase difference defined between the mono signal and a predetermined first stereo channel;

means for determining of an intermediate phase difference between the second channel of the modified stereo signal and an intermediate mono signal from the calculated phase difference and from the decoded first information;

means for determining the phase difference between the second channel and the mono signal from the intermediate phase difference;

means for synthesizing the stereo signals, by frequency sub-band, starting from the decoded mono signal and from the phase differences determined between the mono signal and the stereo channels.

Lastly, the invention relates to a computer program comprising code instructions for the implementation of the steps of a coding method according to the invention and/or of a decoding method according to the invention.

The invention relates finally to a storage means readable by a processor storing in memory a computer program such as described.

BRIEF DESCRIPTION OF THE DRAWINGS

Other features and advantages of the invention will become more clearly apparent upon reading the following description, given by way of non-limiting example, and presented with reference to the appended drawings, in which.

DETAILED DESCRIPTION OF ILLUSTRATIVE EMBODIMENTS

Figure 1:
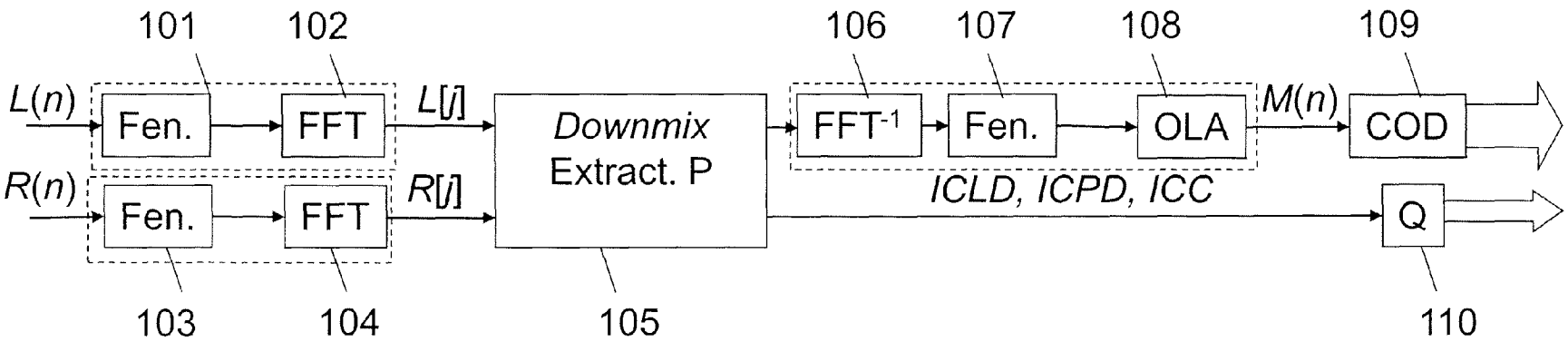
Fig.1 (Prior Art)
FIG. 1 illustrates a coder implementing a parametric coding known from the prior art and previously described.
Figure 2:
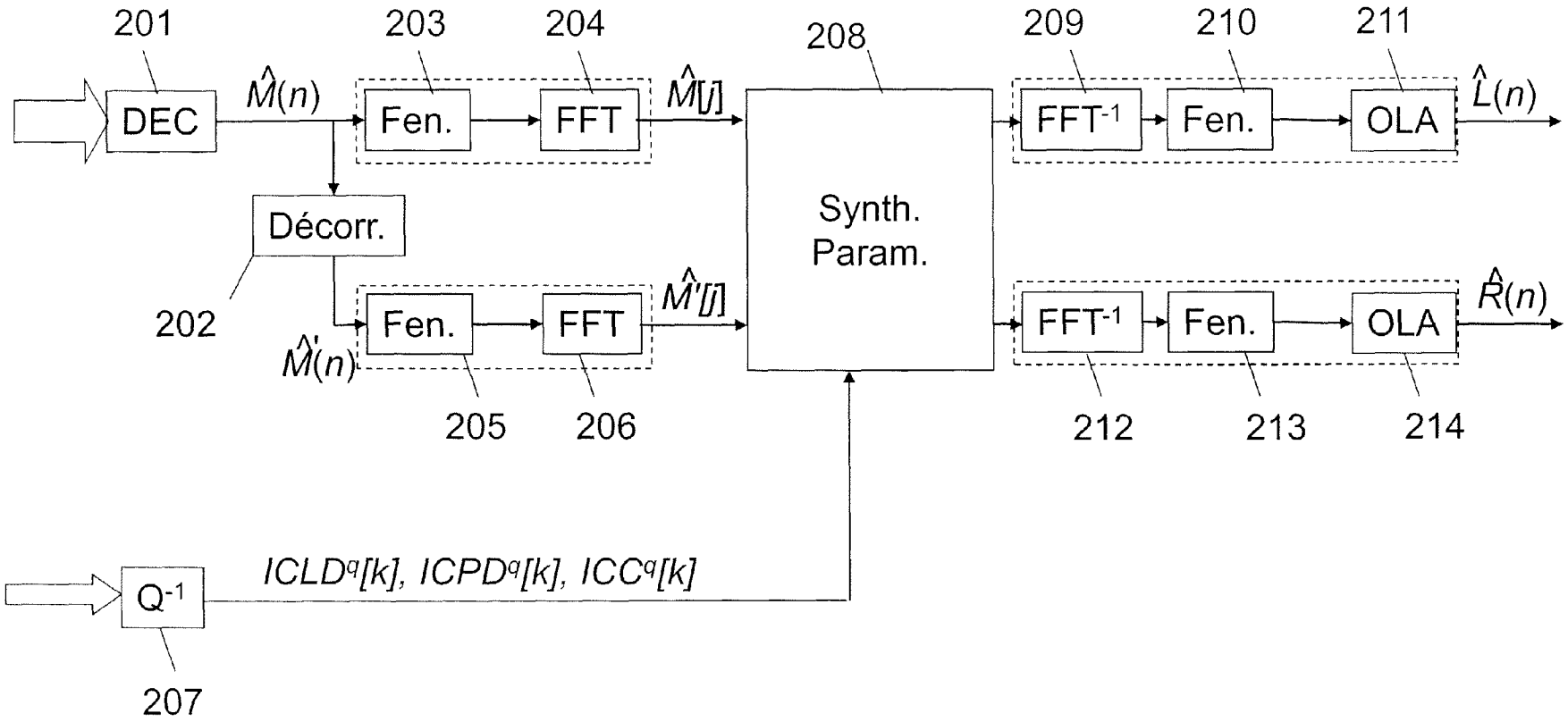
Fig.2 (Prior Art)
FIG. 2 illustrates a decoder implementing a parametric decoding known from the prior art and previously described.
Figure 3:
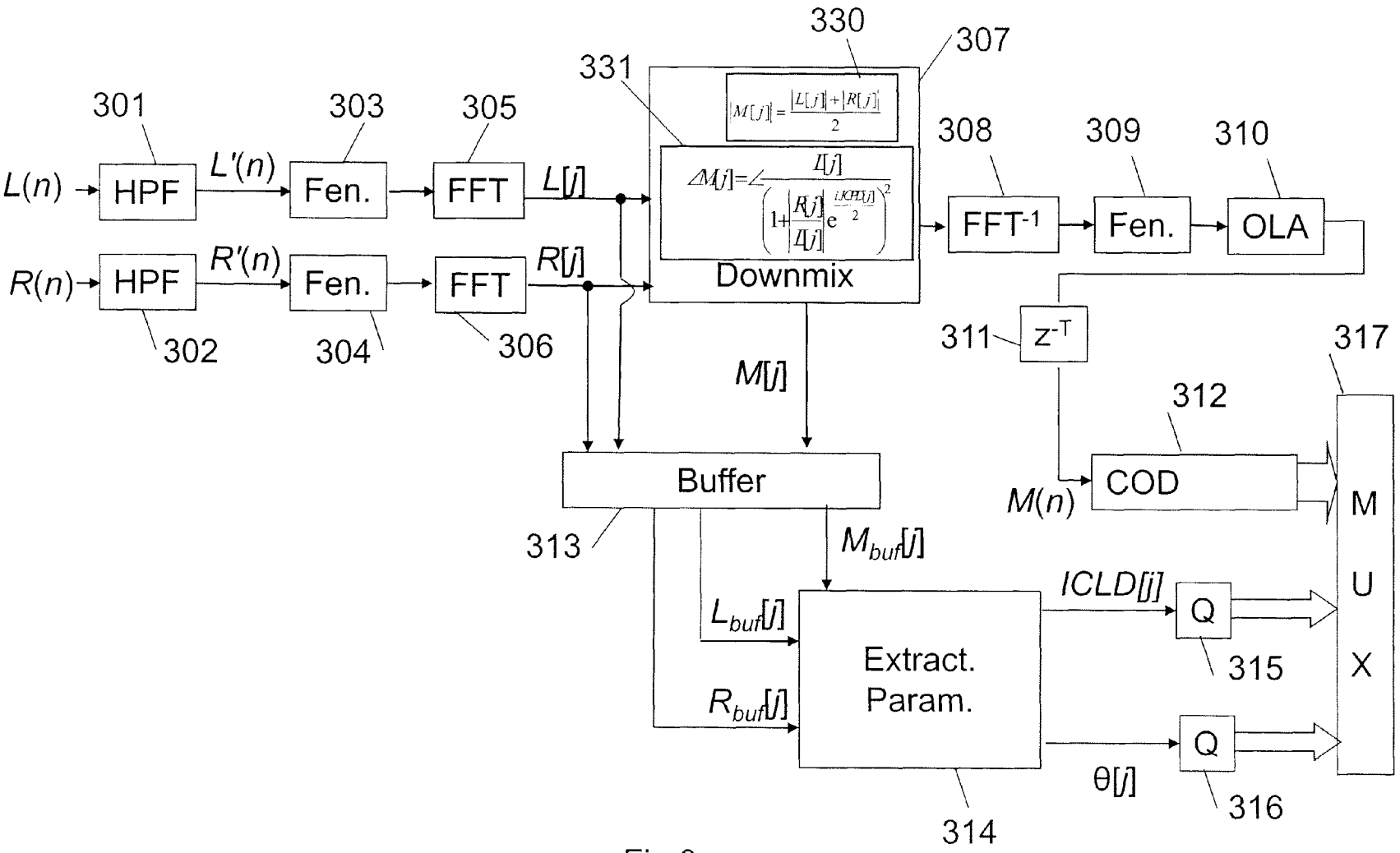
FIG. 3 illustrates a stereo parametric coder according to one embodiment of the invention.

With reference to FIG. 3, a parametric coder for stereo signals according to one embodiment of the invention, delivering both a mono signal and spatial information parameters of the stereo signal is now described.

This parametric stereo coder such as illustrated uses a mono G.722 coding at 56 or 64 kbit/s and extends this coding by operating in a widened band with stereo signals sampled at 16 kHz with frames of 5 ms. It should be noted that the choice of a frame length of 5 ms is in no way restrictive in the invention which is just as applicable in variants of the embodiment where the frame length is different, for example 10 or 20 ms. Furthermore, the invention is just as applicable to other types of mono coding, such as an improved version interoperable with G.722, or other coders operating at the same sampling frequency (for example G.711.1) or at other frequencies (for example 8 or 32 kHz).

Each time-domain channel (L(n) and R(n)) sampled at 16 kHz is firstly pre-filtered by a high-pass filter (or HPF) eliminating the components below 50 Hz (blocks 301 and 302).

The channels L'(n) and R'(n) coming from the pre-filtering blocks are analyzed in frequency by discrete Fourier transform with sinusoidal windowing using 50% overlap with a length of 10 ms, or 160 samples (blocks 303 to 306). For each frame, the signal (L'(n), R'(n)) is therefore weighted by a symmetrical analysis window covering 2 frames of 5 ms, or 10 ms (160 samples). The analysis window of 10 ms covers the current frame and the future frame. The future frame corresponds to a segment of "future" signal, commonly referred to as "lookahead", of 5 ms.

For the current frame of 80 samples (5 ms at 16 kHz), the spectra obtained, L[j] and R[j] (j=0 . . . 80), comprise 81 complex coefficients, with a resolution of 100 Hz per frequency coefficient. The coefficient of index j=0 corresponds to the DC component (0 Hz), which is real. The coefficient of index j=80 corresponds to the Nyquist frequency (8000 Hz), which is also real. The coefficients of index 0<j<80 are complex and correspond to a sub-band of width 100 Hz centered on the frequency of j.

The spectra L[j] and R[j] are combined in the block 307 described later on for obtaining a mono signal (downmix)

M[j] in the frequency domain. This signal is converted into time by inverse FFT and overlap-add with the 'lookahead' part of the preceding frame (blocks 308 to 310).

Since the algorithmic delay of G.722 is 22 samples, the mono signal is delayed (block 311) by T=80-22 samples such that the delay accumulated between the decoded mono signal by G.722 and the original stereo channels becomes a multiple of the frame length (80 samples). Subsequently, in order to synchronize the extraction of stereo parameters (block 314) and the spatial synthesis based on the mono signal carried out in the decoder, a delay of 2 frames must be introduced into the coder-decoder. The delay of 2 frames is specific to the implementation detailed here, in particular it is linked to the sinusoidal symmetric windows of 10 ms.

This delay could be different. In one variant embodiment, a delay of one frame could be obtained with a window optimized with a smaller overlap between adjacent windows with a block 311 not introducing any delay (T=0).

It is considered in one particular embodiment of the invention, illustrated here in FIG. 3, that the block 313 introduces a delay of two frames on the spectra L[j], R[j] and M[j] in order to obtain the spectra $L_{buf}[j]$, $R_{buf}[j]$ and $M_{buf}[j]$.

In a more advantageous manner in terms of quantity of data to be stored, the outputs of the block 314 for extraction of the parameters or else the outputs of the quantization blocks 315 and 316 could be shifted. This shift could also be introduced in the decoder upon receiving the stereo improvement layers.

In parallel with the mono coding, the coding of the stereo spatial information is implemented in the blocks 314 to 316.

The stereo parameters are extracted (block 314) and coded (blocks 315 and 316) from the spectra L[j], R[j] and M[j] shifted by two frames: $L_{buf}[j]$, $R_{buf}[j]$ and $M_{buf}[j]$.

The block for channel reduction processing 307, or downmixing, is now described in more detail.

The latter carries out, according to one embodiment of the invention, a downmix in the frequency domain so as to obtain a mono signal M[j].

Figure 4A:
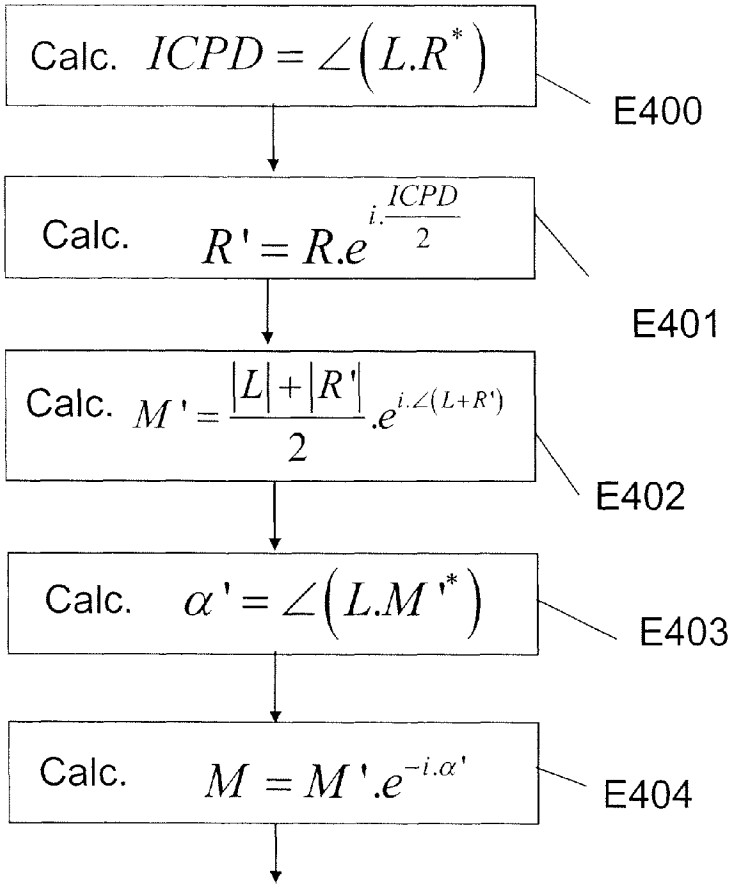
FIGS. 4*a* and 4*b* illustrate, in the form of flow diagrams, the steps of a coding method according to variant embodiments of the invention.
Figure 4B:
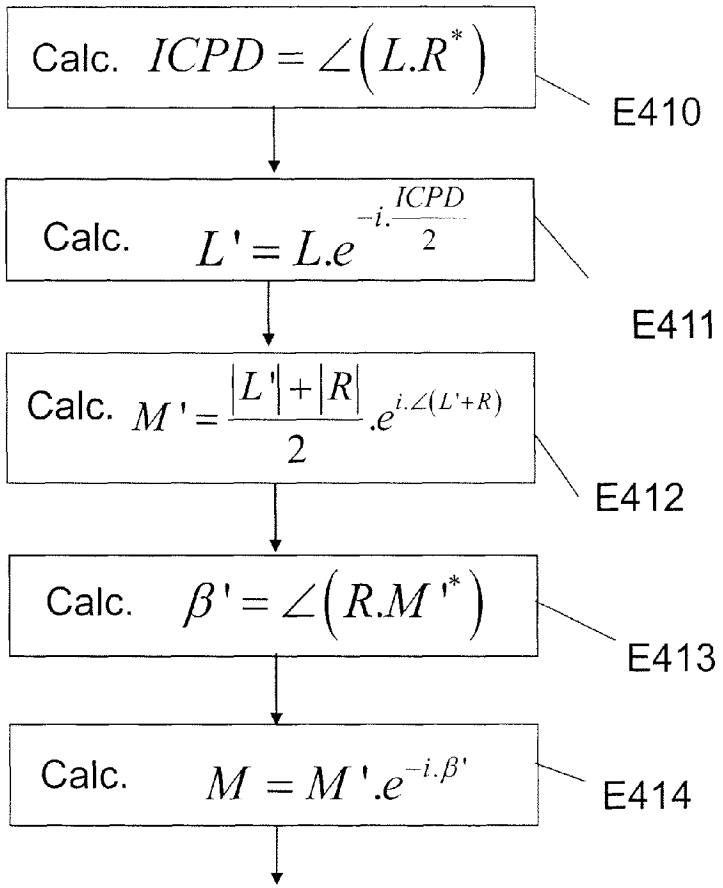

According to the invention, the principle of channel reduction processing is carried out according to the steps E400 to E404 or according to the steps E410 to E414 illustrated in FIGS. 4*a* and 4*b*. These figures show two variants that are equivalent from the point of view of results.

Thus, according to the variant in FIG. 4*a*, a first step E400 determines the phase difference, by frequency line j, between the L and R channels defined in the frequency domain. This phase difference corresponds to the ICPD parameters such as described previously and defined by the following formula:

$$\mathrm{ICPD}[j]=\angle(L[j]\cdot R[j]^*) \tag{13}$$

where j=0, . . . , 80 and ∠(.) represents the phase (complex argument).

At the step E401, a modification of the stereo channel R is carried out in order to obtain an intermediate channel R'. The determination of this intermediate channel is carried out by rotation of the R channel through an angle obtained by reduction of the phase difference determined at the step E400.

In one particular embodiment described here, the modification is carried out by a rotation of the initial R channel through an angle of ICPD/2 so as to obtain the channel R' according to the following formula:

$$R'[j]=R[j]e^{i\cdot ICPD[j]/2} \tag{14}$$

Thus, the phase difference between the two channels of the stereo signal is reduced by half in order to obtain the intermediate channel R'.

In another embodiment, the rotation is applied with a different angle, for example an angle of 3.ICPD[j]/4. In this case, the phase difference between the two channels of the stereo signal is reduced by ¾ in order to obtain the intermediate channel R'.

At the step E 402, an intermediate mono signal is calculated from the channels L[j] and R'[j]. This calculation is performed by frequency coefficient. The amplitude of the intermediate mono signal is obtained by averaging the amplitudes of the intermediate channel R' and of the L channel and the phase is obtained by the phase of the signal summing the second L channel and the intermediate channel R' (L+R'), according to the following formula:

$$\begin{cases} |M'[j]| = \dfrac{|L[j]|+|R'[j]|}{2} = \dfrac{|L[j]|+|R[j]|}{2} \\ \angle M'[j] = \angle(L[j]+R'[j]) \end{cases} \tag{15}$$

where |.| represents the amplitude (complex modulus).

At the step E403, the phase difference (α'[j]) between the intermediate mono signal and the second channel of the stereo signal, here the L channel, is calculated. This difference is expressed in the following manner:

$$\alpha'[j]=\angle(L[j]\cdot M'[j]^*) \tag{16}$$

Using this phase difference, the step E404 determines the mono signal M by rotation of the intermediate mono signal through the angle α'.

The mono signal M is calculated according to the following formula:

$$M[j]=M'[j]\cdot e^{-i\alpha'[j]} \tag{17}$$

It is to be noted that if the modified channel R' had been obtained by rotation of R through an angle 3.ICPD [j]/4, then a rotation of M' through an angle of 3. α' would be needed in order to obtain M; the mono signal M would however be different from the mono signal calculated in the equation 17.

Figure 5:
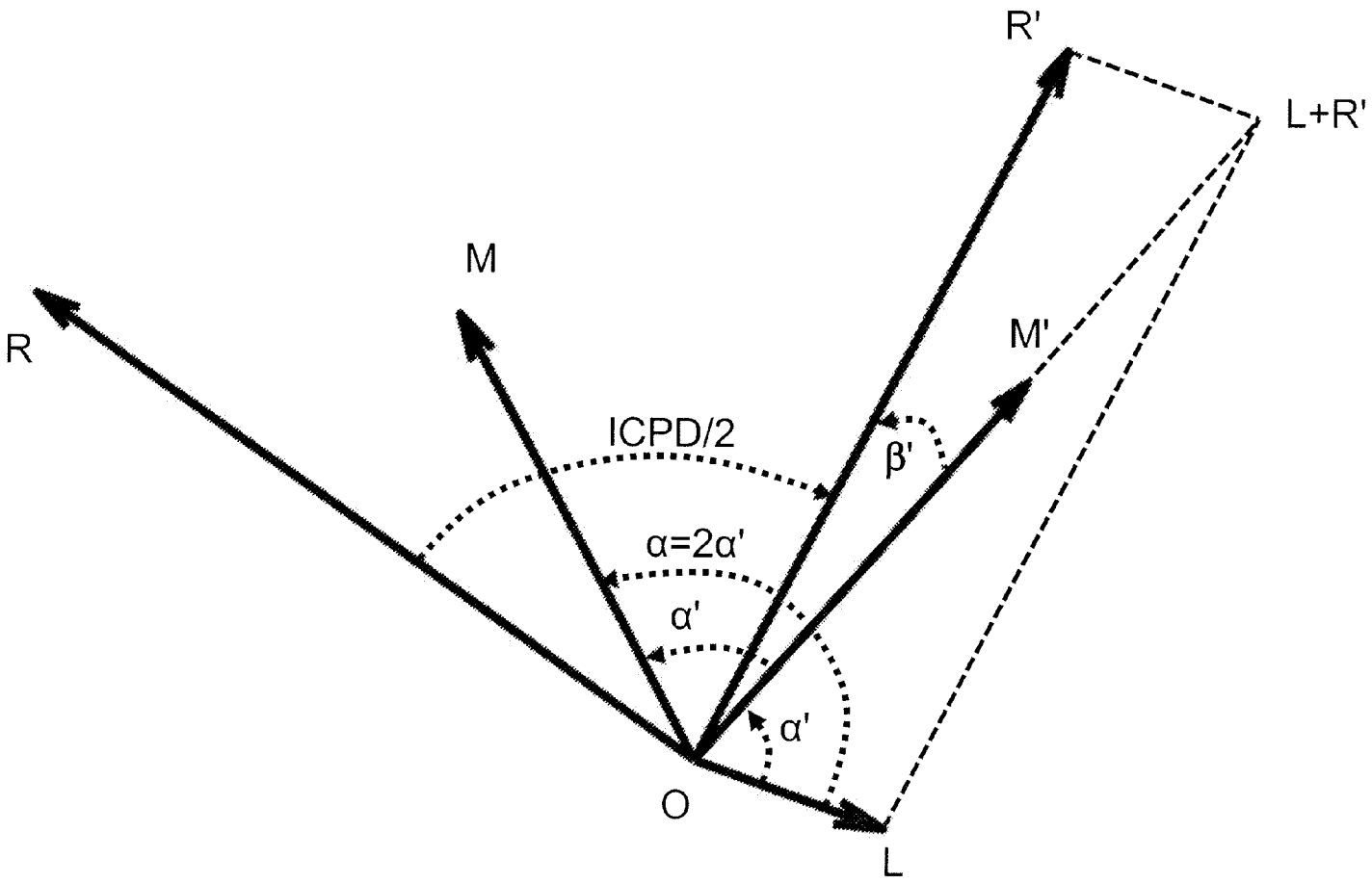
FIG. 5 illustrates one mode of calculation of the spatialization information in one particular embodiment of the invention.

FIG. 5 illustrates the phase differences mentioned in the method described in FIG. 4*a* and thus shows the mode of calculation of these phase differences.

The illustration is presented here with the following values: ICLD=−12 dB and ICPD=165°. The signals L and R are therefore in virtual phase opposition.

Thus, the angle ICPD/2 may be noted between the R channel and the intermediate channel R', and the angle α' between the intermediate mono channel M' and the L channel. It can thus be seen that the angle α' is also the difference between the intermediate mono channel M' and the mono channel M, by construction of the mono channel.

Thus, as shown in FIG. 5, the phase difference between the L channel and the mono channel $$\alpha[j]=\angle(L[j]\cdot M[j]^*) \tag{18}$$

verifies the equation: α=2α'.

Thus, the method such as described with reference to FIG. 4*a* requires the calculation of three angles or phase differences:

- the phase difference between the two original stereo channels L and R (ICPD)
- the phase of the intermediate mono signal ∠ M'[j]
- the angle α'[j] for applying the rotation of M' in order to obtain M.

FIG. 4*b* shows a second variant of the downmixing method, in which the modification of the stereo channel is performed on the L channel (instead of R) rotated through an angle of −ICPD/2 (instead of ICPD/2) in order to obtain an intermediate channel L' (instead of R'). The steps E410 to E414 are not presented here in detail because they correspond to the steps E400 to E404 adapted to the fact that the modified channel is no longer R' but L'. It may be shown that the mono signals M obtained from the L and R' channels or the R and L' channels are identical. Thus, the mono signal M is independent of the stereo channel to be modified (L or R) for a modification angle of ICPD/2.

It may be noted that other variants mathematically equivalent to the method illustrated in FIGS. 4*a* and 4*b* are possible.

In one equivalent variant, the amplitude |M'[j]| and the phase ∠M'[j] of M' are not calculated explicitly. Indeed, it suffices to directly calculate M' in the form:

$$M'[j] = \frac{(|L[j]| + |R'[j]|)/2}{|L[j] + R'[j]|}.(L[j] + R'[j]) \tag{19}$$

Thus, only two angles (ICPD) and α'[j] need to be calculated. However, this variant requires the amplitude of L+R' to be calculated and a division to be performed, and division is an operation that is often costly in practice.

In another equivalent variant, M[j] is directly calculated in the form:

$$\begin{cases} |M[j]| = \dfrac{|L[j]| + |R[j]|}{2} \\ \angle M[j] = \angle L[j] - \angle\left(1 + \dfrac{1}{|L[j]|}R'[j]\right)^2 = \angle L[j] - \angle\left(1 + \left|\dfrac{R[j]}{L[j]}\right|e^{i\frac{ICPD[j]}{2}}\right)^2 \end{cases}$$

or, in an equivalent manner:

$$\angle M[j] = -\angle\left(\frac{\left(1 + \left|\frac{R[j]}{L[j]}\right|e^{i\frac{ICPD[j]}{2}}\right)^2}{L[j]}\right) \tag{20}$$

It may be shown mathematically that the calculation of ∠M[j] yields an identical result to the methods in FIGS. 4*a* and 4*b*. However, in this variant, the angle α'[j] is not calculated, which is a disadvantage since this angle is subsequently used in the coding of the stereo parameters.

In another variant, the mono signal M will be able to be deduced from the following calculation:

$$\begin{cases} |M[j]| = \dfrac{|L[j]| + |R[j]|}{2} \\ \angle M[j] = \angle L[j] - 2.\alpha'[j] \end{cases}$$

The preceding variants have considered various ways of calculating the mono signal according to FIG. 4*a* or 4*b*. It is noted that the mono signal may be calculated either directly via its amplitude and its phase, or indirectly by rotation of the intermediate mono channel M'.

In any case, the determination of the phase of the mono signal is carried out starting from the phase of the signal summing the intermediate channel and the second stereo signal and from a phase difference between, on the one hand, the signal summing the intermediate channel and the second channel and, on the other hand, the second channel of the stereo signal.

A general variant of the calculation of the downmix is now presented where a primary channel X and a secondary channel Y are differentiated. The definition of X and Y is different depending on the lines j in question:

for j=2, . . . , 9, the channels X and Y are defined based on locally decoded channels L̂[j] and R̂[j] such that $$\begin{cases} X[j] = L[j].\dfrac{c_1[j]}{|L[j]|} \\ Y[j] = R[j].\dfrac{c_2[j]}{|R[j]|} \end{cases} \text{ if } \hat{I}[j] \geq 1$$

and $$\begin{cases} X[j] = R[j].\dfrac{c_2[j]}{|R[j]|} \\ Y[j] = L[j]..\dfrac{c_1[j]}{|L[j]|} \end{cases} \text{ if } \hat{I}[j] < 1$$

where |Î[j]| represents the amplitude ratio between the decoded channels L[j] and R[j]; the ratio Î[j] is available in the decoder as it is in the coder (by local decoding). The local decoding of the coder is not shown in FIG. 3 for the sake of clarity.

The exact definition of the ratio Î[j] is given hereinbelow in the detailed description of the decoder. It will be noted that, in particular, the amplitudes of the decoded L and R channels give:

$$\hat{I}[j] = \frac{c_1[j]}{c_2[j]}$$

For j outside of the interval [2,9], the channels X and Y are defined based on the original channels L[j] and R[j] such that $$\begin{cases} X[j] = L[j] \\ Y[j] = R[j] \end{cases} \text{ if } \left|\frac{L[j]}{R[j]}\right| \geq 1$$

and $$\begin{cases} X[j] = R[j] \\ Y[j] = L[j] \end{cases} \text{ if } \left|\frac{L[j]}{R[j]}\right| < 1$$

This distinction between lines of index j within the interval [2,9] or outside is justified by the coding/decoding of the stereo parameters described hereinbelow.

In this case, the mono signal M can be calculated from X and Y by modifying one of the channels (X or Y). The calculation of M from X and Y is deduced from FIGS. 4*a* and 4*b* as follows:

When Î[j]<1 (j=2, . . . 9) or $$\left|\frac{L[j]}{R[j]}\right| < 1$$

(other values of j), the downmix laid out in FIG. 4*a* is applied by respectively replacing L and R by Y and X When Î[j]≥1 (j=2, . . . 9) or $$\left|\frac{L[j]}{R[j]}\right| \geq 1$$

(other values of j), the downmix laid out in FIG. 4*b* is applied by respectively replacing L and R by X and Y This variant, more complex to implement, is strictly equivalent to the downmixing method detailed previously for the frequency lines of index j outside of the interval [2,9]; on the other hand, for the lines of index j=2, . . . , 9, this variant 'distorts' the L and R channels by taking decoded amplitude values $c_1[j]$ for L and $c_2[j]$ for R—this amplitude 'distortion' has the effect of slightly degrading the mono signal for the lines in question but, in return, it enables the downmixing to be adapted to the coding/decoding of the stereo parameters described hereinbelow and, at the same time, allows the quality of the spatialization in the decoder to be improved.

In another variant of the calculation of the downmix, the calculation is carried out depending on the lines j in question:

for j=2, . . . , 9, the mono signal is calculated by the following formula:

$$\begin{cases} |M[j]| = \dfrac{|L[j]| + |R[j]|}{2} \\ \angle M[j] = \angle L[j] - \angle\left(1 + \dfrac{1}{\hat{I}[j]} e^{i\frac{ICPD[j]}{2}}\right)^2 \end{cases}$$

where $\hat{I}[j]$ represents the amplitude ratio between the decoded channels L[j] and R[j]. The ratio $\hat{I}[j]$ is available in the decoder as it is in the coder (by local decoding).

for j outside of the interval [2,9], the mono signal is calculated by the following formula:

$$\begin{cases} |M[j]| = \dfrac{|L[j]| + |R[j]|}{2} \\ \angle M[j] = \angle L[j] - \angle\left(1 + \left|\dfrac{R[j]}{L[j]}\right| e^{i\frac{ICPD[j]}{2}}\right)^2 \end{cases}$$

This variant is strictly equivalent to the method of downmixing detailed previously for the frequency lines of index j outside of the interval [2,9]; on the other hand, for the lines of index j=2, . . . , 9, it uses the ratio of the decoded amplitudes in order to adapt the downmix to the coding/decoding of the stereo parameters described hereinbelow. This allows the quality of the spatialization in the decoder to be improved.

In order to take in to account other variants coming into the scope of the invention, another example of downmixing applying the principles presented previously is also mentioned here. The preliminary steps for calculating the difference (ICPD) in phase between the stereo channels (L and R) and the modification of a predetermined channel are not repeated here. In the case of FIG. 4*a*, at the step E 402, an intermediate mono signal is calculated from the channels L[j] and R'[j] with:

$$\begin{cases} |M'[j]| = \dfrac{|L[j]| + |R'[j]|}{2} = \dfrac{|L[j]| + |R[j]|}{2} \\ \angle M'[j] = \angle(L[j] + R'[j]) \end{cases}$$

In one possible variant, it is the mono signal M' that will be calculated as follows:

$$M'[j] = \frac{L[j] + R'[j]}{2}$$

This calculation replaces the step E 402, whereas the other steps are preserved (steps 400, 401, 403, 404). In the case in FIG. 4*b*, the signal M' could be calculated in the same way as follows (in replacement for the step E 412):

$$M'[j] = \frac{L'[j] + R[j]}{2}$$

The difference between this calculation of the intermediate downmix M' and the calculation presented previously resides only in the amplitude |M'[j]| of the mono signal M' which will here be slightly different by $$\frac{|L[j]| + |R'[j]|}{2} \text{ or } \frac{|L'[j]| + |R[j]|}{2}.$$

This variant is therefore less advantageous since it does not completely preserve the 'energy' of the components of the stereo signals, on the other hand it is less complex to implement. It is interesting to note that the phase of the resulting mono signal remains however identical! Thus, the coding and decoding of the stereo parameters presented in the following remain unchanged if this variant of the downmix is implemented since the coded and decoded angles remain the same.

Thus, the "downmix" according to the invention differs from the technique of Samsudin et al. in the sense that a channel (L, R or X) is modified by rotation through an angle less than the value of ICPD, this angle of rotation is obtained by reduction of the ICPD with a factor <1, whose typical value is ½—even if the example of ¾ has also been given without limiting the possibilities. The fact that the factor applied to the ICPD has a value strictly less than 1 allows the angle of rotation to be qualified as the result of a 'reduction' in the phase difference ICPD. Moreover, the invention is based on a downmix referred to as 'intermediate downmix', two essential variants of which have been presented. This intermediate downmix produces a mono signal whose phase (by frequency line) does not depend on a reference channel (except in the trivial case where one of the stereo channels is zero, this being an extreme case which is not relevant in the general case).

In order to adapt the spatialization parameters to the mono signal such as obtained by the downmix processing described hereinabove, one particular extraction of the parameters by the block 314 is now described with reference to FIG. 3.

For the extraction of the ICLD parameters (block 314), the spectra $L_{buf}[j]$ and $R_{buf}[j]$ are divided up into 20 sub-bands of frequencies. These sub-bands are defined by the following boundaries:

$\{B[k]\}_{k=0,\ldots,20}$=[0, 1, 2, 3, 4, 5, 6, 7, 9, 11, 13, 16, 19, 23, 27, 31, 37, 44, 52, 61, 80]

The table hereinabove bounds (in number of Fourier coefficients) the frequency sub-bands of index k=0 to 19. For example, the first sub-band (k=0) goes from the coefficient B[k]=0 to B[k+1]−1=0; it is therefore reduced to a single coefficient which represents 100 Hz (in reality, 50 Hz if only the positive frequencies are taken). Similarly, the last sub-band (k=19) goes from the coefficient B[k]=61 to B[k+1]−1=79 and comprises 19 coefficients (1900 Hz). The frequency line of index j=80 which corresponds to the Nyquist frequency is not taken into account here.

For each frame, the ICLD of the sub-band k=0, . . . , 19 is calculated according to the equation:

$$ICLD[k] = 10.\log_{10}\left(\frac{\sigma_L^2[k]}{\sigma_R^2[k]}\right)\text{dB} \tag{21}$$

where $\sigma_L^2[k]$ and $\sigma_R^2[k]$ respectively represent the energy of the left channel ($L_{buf}$) and of the right channel ($R_{buf}$):

$$\begin{cases} \sigma_L^2[k] = \sum_{j=B[k]}^{B[k+1]-1} L_{buf}[j]^2 \\ \sigma_R^2[k] = \sum_{j=B[k]}^{B[k+1]-1} R_{buf}[j]^2 \end{cases} \quad (22)$$

According to one particular embodiment, in a first stereo extension layer (+8 kbit/s), the parameters ICLD are coded by a differential non-uniform scalar quantization (block 315) over 40 bits per frame. This quantization will not be detailed here since this falls outside of the scope of the invention.

According to the work by J. Blauert, "Spatial Hearing: The Psychophysics of Human Sound Localization", revised edition, MIT Press, 1997, it is known that the phase information for the frequencies lower than 1.5-2 kHz is particularly important in order to obtain a good stereo quality. The time-frequency analysis carried out here gives 81 complex frequency coefficients per frame, with a resolution of 100 Hz per coefficient. Since the budget of bits is 40 bits and the allocation is, as explained hereinbelow, 5 bits per coefficient, only 8 lines can be coded. By experimentation, the lines of index j=2 to 9 have been chosen for this coding of the phase information. These lines correspond to a frequency band from 150 to 950 Hz.

Thus, for the second stereo extension layer (+8 kbit/s) the frequency coefficients where the phase information is perceptually the most important are identified, and the associated phases are coded (block 316) by a technique detailed hereinafter with reference to FIGS. 6*a* and 6*b* using a budget of 40 bits per frame.

Figure 6A:
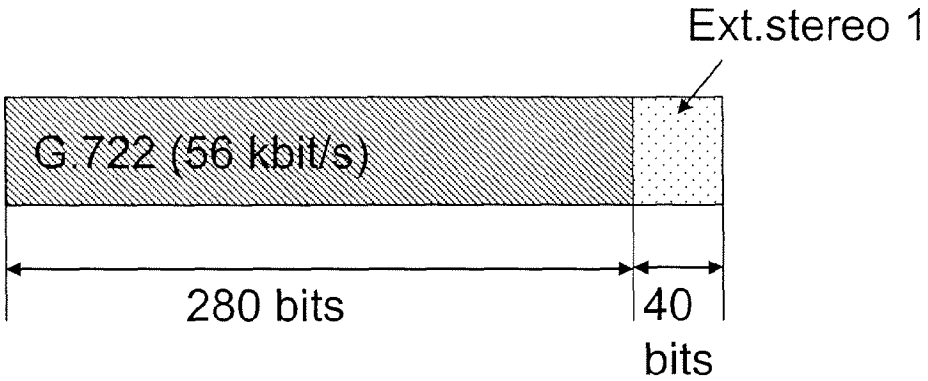
FIGS. 6*a* and 6*b* illustrate the binary train of the spatialization information coded in one particular embodiment.
Figure 6B:
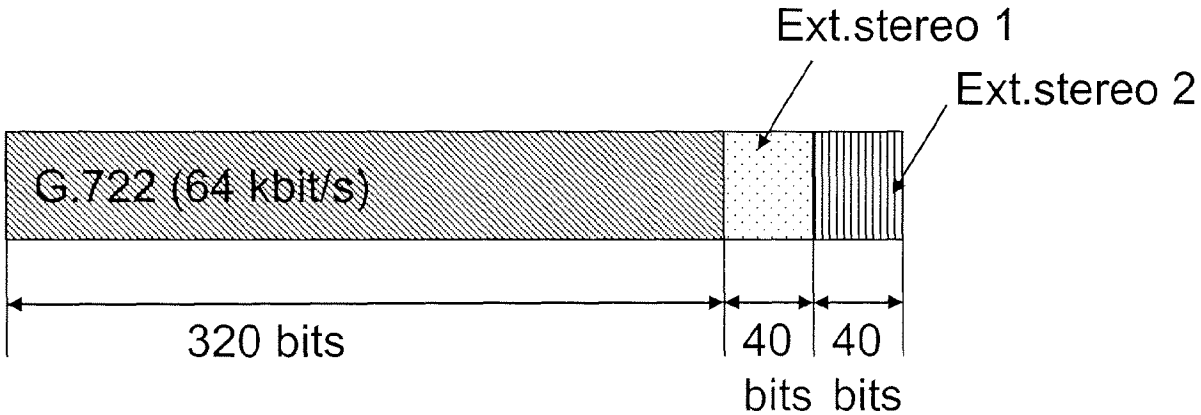

FIGS. 6*a* and 6*b* present the structure of the binary train for the coder in one preferred embodiment; this is a hierarchical binary train structure coming from the scalable coding with a core coding of the G.722 type.

The mono signal is thus coded by a G.722 coder at 56 or 64 kbit/s.

In FIG. 6*a*, the G.722 core coder operates at 56 kbit/s and a first stereo extension layer (Ext.stereo 1) is added.

In FIG. 6*b*, the core coder G.722 operates at 64 kbit/s and two stereo extension layers (Ext.stereo 1 and Ext.stereo 2) are added.

Hence, the coder operates according to two possible modes (or configurations):

- a mode with a data rate of 56+8 kbit/s (FIG. 6*a*) with a coding of the mono signal (downmix) by a G.722 coding at 56 kbit/s and a stereo extension of 8 kbit/s.
- a mode with a data rate of 64+16 kbit/s (FIG. 6*b*) with a coding of the mono signal (downmix) by a G.722 coding at 64 kbit/s and a stereo extension of 16 kbit/s.

For this second mode, it is assumed that the additional 16 kbit/s are divided into two layers of 8 kbit/s whose first is identical in terms of syntax (i.e. coded parameters) to the improvement layer of the 56+8 kbit/s mode.

Thus, the binary train shown in FIG. 6*a* comprises the information on the amplitude of the stereo channels, for example the ICLD parameters such as described hereinabove. In one preferred variant of the embodiment of the coder, an ICTD parameter of 4 bits is also coded in the first layer of coding.

The binary train shown in FIG. 6*b* comprises both the information on the amplitude of the stereo channels in the first extension layer (and an ICTD parameter in one variant) and the phase information of the stereo channels in the second extension layer. The division into two extension layers shown in FIGS. 6*a* and 6*b* could be generalized to the case where at least one of the two extension layers comprises both a part of the information on the amplitude and a part of the information on the phase.

In the embodiment described previously, the parameters which are transmitted in the second stereo improvement layer are phase differences θ[j] for each line j=2, . . . , 9 coded over 5 bits in the interval [−π, π] according to a uniform scalar quantization with a pitch of π/16. In the following paragraphs, it is described how these phase differences θ[j] are calculated and coded in order to form the second extension layer after multiplexing of the indices of each line j=2, . . . , 9.

In the preferred embodiment of the blocks 314 and 316, a primary channel X and a secondary channel Y are determined for each Fourier line of index j, starting from the L and R channels, in the following manner:

$$\begin{cases} X_{buf}[j] = L_{buf}[j] \\ Y_{buf}[j] = R_{buf}[j] \end{cases} \text{ if } \hat{I}_{buf}[j] \geq 1$$

and $$\begin{cases} X_{buf}[j] = R_{buf}[j] \\ Y_{buf}[j] = L_{buf}[j] \end{cases} \text{ if } \hat{I}_{buf}[j] < 1$$

where Î[j] corresponds to the amplitude ratio of the stereo channels, calculated from the ICLD parameters according to the formula:

$$\hat{I}_{buf}[j] = 10^{ICLD^q_{buf}[k]/20} \quad (23)$$

where $ICLD^q_{buf}[k]$ is the decoded ICLD parameter (q as quantified) for the sub-band of index k in which the frequency line of index j is situated.

It is to be noted that, in the definition of $X_{buf}[j]$, $Y_{buf}[j]$ and $\hat{I}_{buf}[j]$ hereinabove, the channels used are the original channels $L_{buf}[j]$ and $R_{buf}[j]$ shifted by a certain number of frames; since it is angles that are calculated, the fact that the amplitude of these channels is the original amplitude or the locally decoded amplitude does not matter. On the other hand, it is important to use as criterion for distinguishing between X and Y the information $I_{buf}[j]$ in such a manner that the coder and decoder use the same calculation/decoding conventions for the angle θ[j]. The information $\hat{I}_{buf}[j]$ is available in the coder (by local decoding and shifting by a certain number of frames). The decision criterion $\hat{I}_{buf}[j]$ used for the coding and the decoding of θ[j] is therefore identical for the coder and the decoder.

Using $X_{buf}[j]$, $Y_{buf}[j]$, the phase difference between the secondary channel $Y_{buf}$ [j] and the mono signal may be defined as $$\theta[j] = \angle(Y_{buf}[j] \cdot M_{buf}[j]^*)$$

The differentiation between primary and secondary channels in the preferred embodiment is motivated mainly by the fact that the fidelity of the stereo synthesis is different according to whether the angles transmitted by the coder are $\alpha_{buf}[j]$ or $\beta_{buf}[j]$ depending on the amplitude ratio between L and R.

In one variant embodiment, the channels $X_{buf}[j]$, $Y_{buf}[j]$ will not be defined but θ[j] will be calculated in an adaptive manner as:

$$\theta[j] = \begin{cases} \alpha_{buf}[j] = \angle(L_{buf}[j].M_{buf}[j]^*) & \text{if } \hat{I}_{buf}[j] < 1 \\ \beta_{buf}[j] = \angle(R_{buf}[j].M_{buf}[j]^*) & \text{if } \hat{I}_{buf}[j] \geq 1 \end{cases}$$

Furthermore, in the case where the mono signal is calculated according to the variant distinguishing the channels X and Y, the angle θ[j] already available from the calculation of the downmix (except for a shift by a certain number of frames) could be reused.

In the illustration in FIG. 5, the L channel is secondary and, by applying the invention, $\theta[j]=\alpha_{buf}[j]$ is found—in order to simplify the notations in the figures, the index "buf" is not shown in FIG. 5 which is used both to illustrate the calculation of the downmix and the extraction of the stereo parameters. It should however be noted that the spectra $L_{buf}[j]$ and $R_{buf}[j]$ are shifted by 2 frames with respect to L[j] and R[j]. In one variant of the invention depending on the windowing used (blocks 303, 304) and on the delay applied to the downmixing (block 311), this shift is only by one frame.

For a given line j, the angles α[j] and β[j] verify:

$$\begin{cases} \alpha[j] = 2\alpha'[j] \\ \beta[j] = 2\beta'[j] \end{cases}$$

where the angles α'[j] and β'[j] are the phase differences between the secondary channel (here L) and the intermediate mono channel (M') and between the returned primary channel (here R') and the intermediate mono channel (M'), being respectively (FIG. 5):

$$\begin{cases} \alpha'[j] = \angle(L[j].M'[j]^*) \\ \beta'[j] = \angle(R'[j].M'[j]^*) \end{cases}$$

Thus, it is possible for the coding of α[j] to reuse the calculation of α'[j] performed during the calculation of the downmix (block 307), and to thus avoid the calculation of an additional angle; it is to be noted that, in this case, a shift of two frames must be applied to the parameters α'[j] or α[j] calculated in the block 307. In one variant, the coded parameters will be the parameters θ[j] defined by:

$$\theta'[j] = \begin{cases} \alpha'_{buf}[j] = \angle(L_{buf}[j].M'_{buf}[j]^*) & \text{if } \hat{I}[j] < 1 \\ \beta'_{buf}[j] = \angle(R'_{buf}[j].M'_{buf}[j]^*) & \text{if } \hat{I}[j] \geq 1 \end{cases}$$

Since the total budget of the second layer is 40 bits per frame, only the parameters θ[j] associated with 8 frequency lines are therefore coded, preferably for the lines of index j=2 to 9.

In summary, in the first stereo extension layer, the ICLD parameters of 20 sub-bands are coded by non-uniform scalar quantization (block 315) over 40 bits per frame. In the second stereo extension layer, the angles θ[j] are calculated for j=2, . . . , 9 and coded by uniform scalar quantization of PI/16 over 5 bits.

The budget allocated for coding this phase information is only one particular exemplary embodiment. It may be lower and, in this case, will only take into account a reduced number of frequency lines or, on the contrary, higher and may enable a greater number of frequency lines to be coded.

Similarly, the coding of this spatialization information over two extension layers is one particular embodiment. The invention is also applicable to the case where this information is coded within a single coding improvement layer.

Figure 7A:
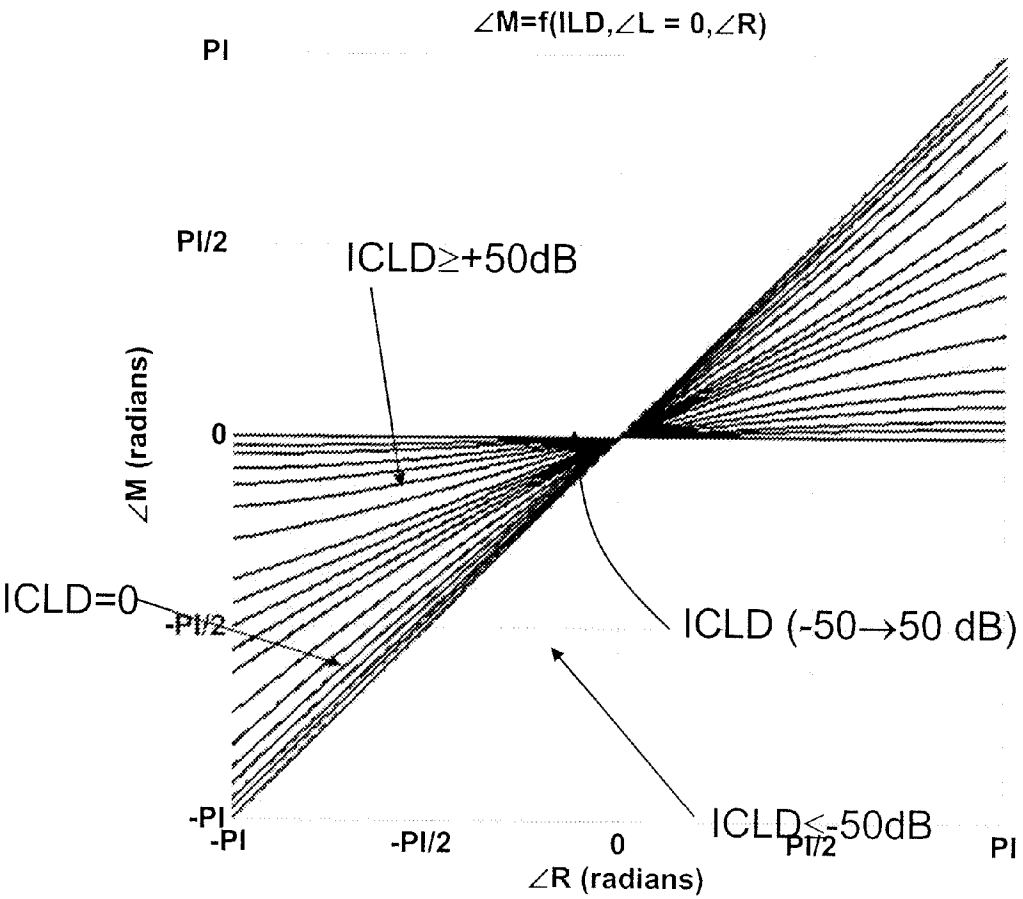
FIGS. 7*a* and 7*b* illustrate, in one case, the non-linearity of the phase of the mono signal in one example of coding not implementing the invention and, in the other case, in a coding implementing the invention.
Figure 7B:
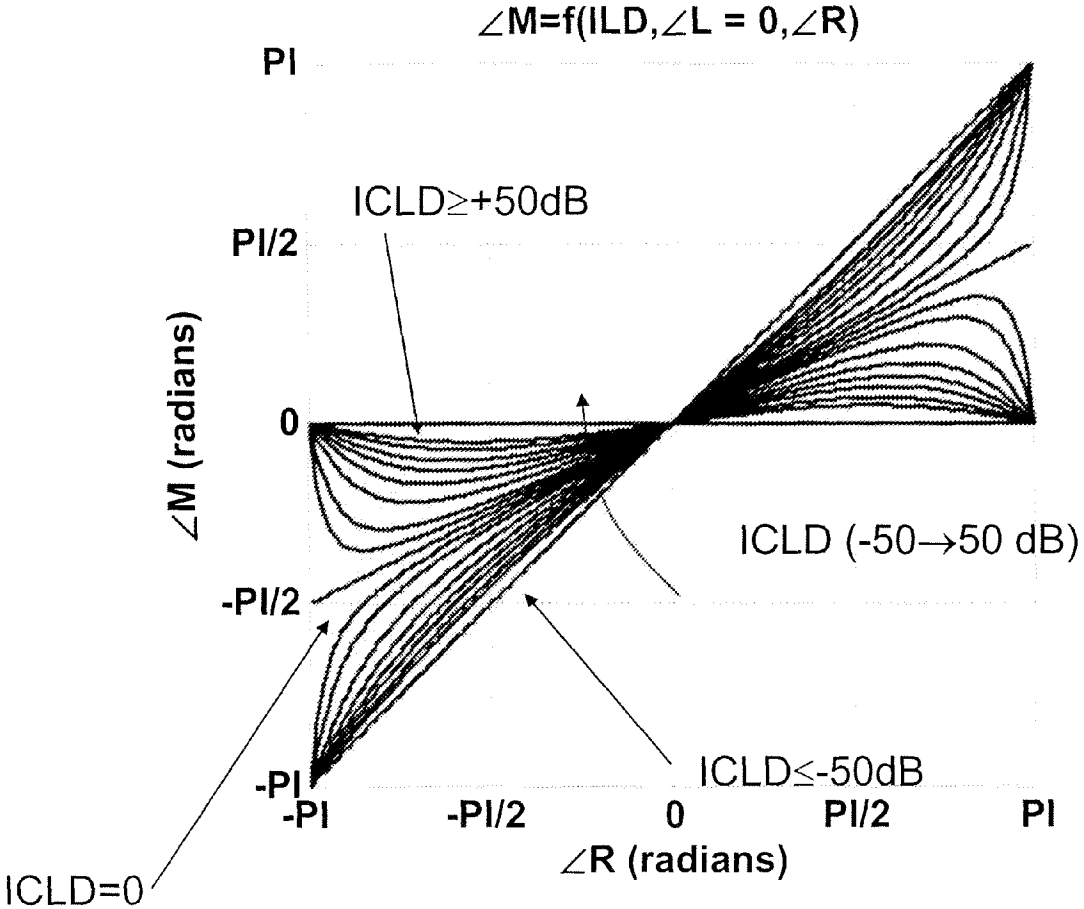

FIGS. 7*a* and 7*b* now illustrate the advantages that may be provided by the channel reduction processing of the invention with respect to other methods.

Thus, FIG. 7*a* illustrates the variation of ∠M[j] for the channel reduction processing described with reference to FIG. 4, as a function of ICLD[j] and ∠R[j]. In order to facilitate the reading, it is posed here that ∠L[j]=0 which gives two degrees of freedom remaining: ICLD[j] and ∠R[j] (which then corresponds to −ICPD[j]). It can be seen that the phase of the mono signal M is virtually linear as a function of ∠R[j] over the whole interval [−PI, PI].

This would not be verified in the case where the channel reduction processing were carried out without modifying the R channel into an intermediate channel by a reduction in the ICLD phase difference.

Indeed, in this scenario, and as illustrated in FIG. 7*b* which corresponds to the downmixing of Hoang et al. (see the IEEE MMSP document cited previously), it can be seen that:

When the phase ∠R[j] is within the interval [−PI/2, PI/2], the phase of the mono signal M is virtually linear as a function of ∠R[j].

Outside of the interval [−PI/2, PI/2], the phase ∠M[j] of the mono signal is non-linear as a function of ∠R[j];

Thus, when the L and R channels are virtually in phase opposition (+/−PI), ∠M[j] takes values around 0, PI/2, or +/−PI depending on the values of the parameter ICLD[j]. For these signals in phase opposition, and close to the phase opposition, the quality of the mono signal can become poor because of the non-linear behavior of the phase of the mono signal ∠M[j]. The limiting case corresponds to opposing channels (R[j]=−L[j]) where the phase of the mono signal becomes mathematically undefined (in practice, constant with a value of zero).

It will thus be clearly understood that the advantage of the invention is in contracting the angular interval in order to limit the calculation of the intermediate mono signal to the interval [−PI/2, PI/2] for which the phase of the mono signal has an almost linear behavior.

The mono signal obtained from the intermediate signal then has a linear phase within the whole interval [−PI, PI] even for signals in phase opposition.

This therefore improves the quality of the mono signal for these type of signals.

In one variant embodiment of the coder, the phase difference $\alpha_{buf}[j]$ between the L and M channels could systematically be coded, instead of coding θ[j]; this variant does not distinguish between the primary and secondary channels, and hence is simpler to implement but it gives a poorer quality of stereo synthesis. The reason for this is that, if the phase difference transmitted to the coder is $\alpha_{buf}[j]$ (instead of θ[j]), the decoder will be able to directly decode the angle $\alpha_{buf}[j]$ between L and M but it will have to 'estimate' the missing (uncoded) angle $\beta_{buf}[j]$ between R and M; it may be shown that the precision of this 'estimation' is not as good when the L channel is the primary one as when the L channel is secondary.

It will also be noted that the implementation of the coder presented previously was based on a downmix using a reduction in the ICPD phase difference by a factor of ½. When the downmix uses another reduction factor (<1), for example a value of ¾, the principle of the coding of the stereo parameters will remain unchanged. In the coder, the second improvement layer will comprise the phase difference ($\theta[m]$ or $\alpha_{buf}[j]$) defined between the mono signal and a predetermined first stereo channel.

Figure 8:
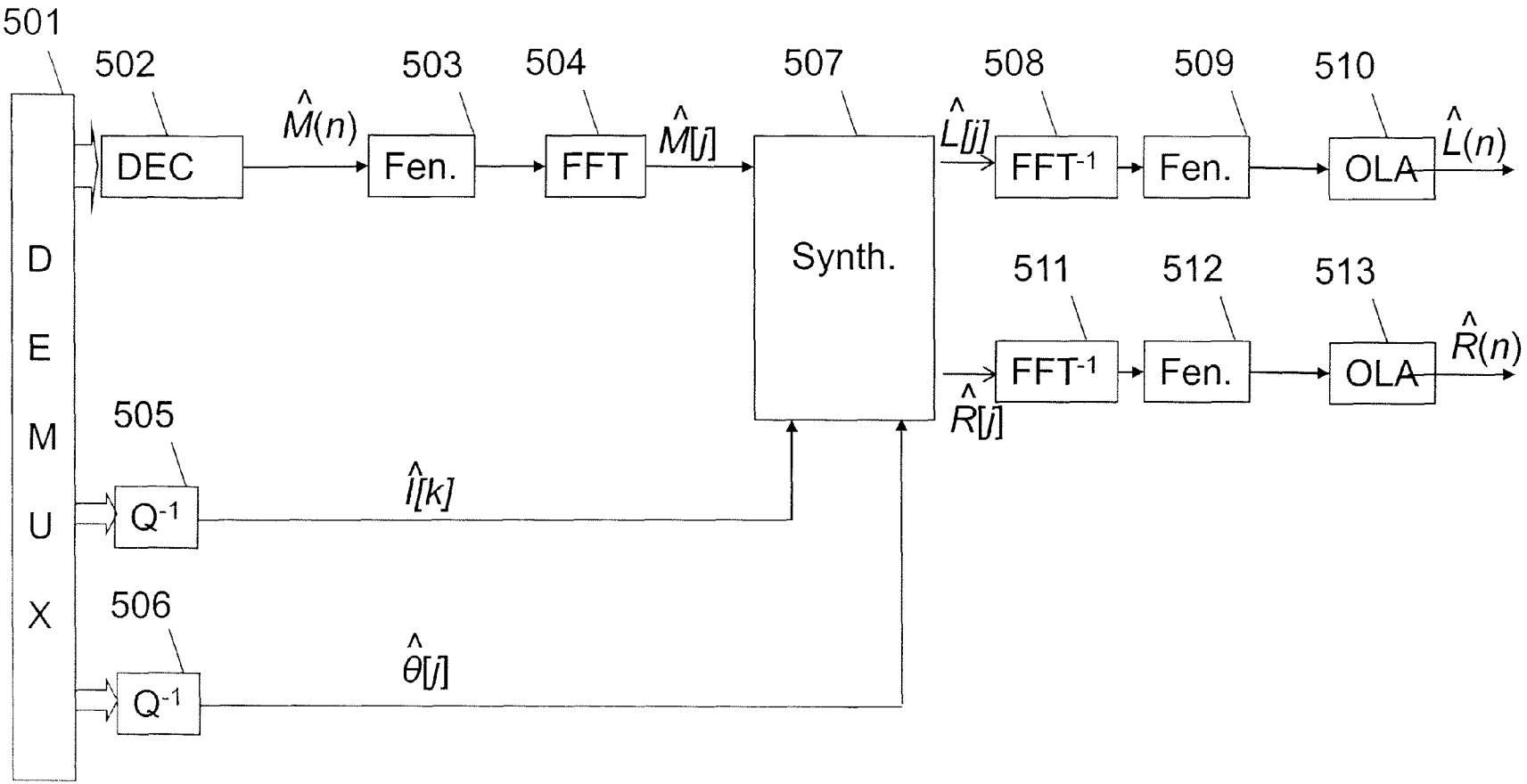
FIG. 8 illustrates a decoder according to one embodiment of the invention.

With reference to FIG. 8, a decoder according to one embodiment of the invention is now described.

This decoder comprises a de-multiplexer 501 in which the coded mono signal is extracted in order to be decoded in 502 by a decoder of the G.722 type, in this example. The part of the binary train (scalable) corresponding to G.722 is decoded at 56 or 64 kbit/s depending on the mode selected. It is assumed here that there is no loss of frames nor binary errors on the binary train in order to simplify the description, however known techniques for correction of loss of frames may of course be implemented in the decoder.

The decoded mono signal corresponds to M (n) in the absence of channel errors. A discrete fast Fourier transform analysis with the same windowing as in the coder is carried out on $\hat{M}(n)$ (blocks 503 and 504) in order to obtain the spectrum $\hat{M}[j]$.

The part of the binary train associated with the stereo extension is also de-multiplexed. The ICLD parameters are decoded in order to obtain $\{ICL^q[k]\}_{k=0,\ldots,19}$ (block 505). The details of the implementation of the block 505 are not presented here because they do not come within the scope of the invention.

The phase difference $\theta[j]$ between the L channel and the signal M by frequency line is decoded for the frequency lines of index j=2, . . . , 9 (block 506) in order to obtain $\hat{\theta}[j]$ according to a first embodiment.

The amplitudes of the left and right channels are reconstructed (block 507) by applying the decoded ICLD parameters by sub-band. The amplitudes of the left and right channels are decoded (block 507) by applying the decoded ICLD parameters by sub-band.

At 56+8 kbit/s, the stereo synthesis is carried out as follows for j=0, . . . , 80:

$$\begin{cases} \hat{L}[j] = c_1[j].\hat{M}[j], \\ \hat{R}[j] = c_2[j].\hat{M}[j] \end{cases} \tag{24}$$

where $c_1[j]$ and $c_2[j]$ are the factors that are calculated from the values of ICLD by sub-band. These factors $c_1[j]$ and $c_2[j]$ take the form:

$$\begin{cases} c_1[j] = \dfrac{2.\hat{I}[j]}{1+\hat{I}[j]} \\ c_2[j] = \dfrac{2}{1+\hat{I}[j]} \end{cases} \tag{25}$$

where $\hat{I}[j]=\mathbf{10}^{ICLD^q[k]/20}$ and k is the index of the sub-band in which the line of index j is situated.

It is to be noted that the parameter ICLD is coded/decoded by sub-band and not by frequency line. It is considered here that the frequency lines of index j belonging to the same sub-band of index k (hence within the interval [B[k], . . . , B[k+1]−1]) have the ICLD value of the ICLD of the sub-band.

It is noted that $\hat{I}[j]$ corresponds to the ratio between the two scale factors:

$$\hat{I}[j] = \frac{c_1[j]}{c_2[j]} \tag{26}$$

and hence to the decoded ICLD parameter (on a linear and not logarithmic scale).

This ratio is obtained from the information coded in the first stereo improvement layer at 8 kbit/s. The associated coding and decoding processes are not detailed here, but for a budget of 40 bits per frame, it may be considered that this ratio is coded by sub-band rather than by frequency line, with a non-uniform division into sub-bands.

In one variant of the preferred embodiment, an ICTD parameter of 4 bits is decoded using the first layer of coding. In this case, the stereo synthesis is modified for the lines j=0, . . . , 15 corresponding to the frequencies lower than 1.5 kHz and takes the form:

$$\begin{cases} \hat{L}[j] = c_1[j].\hat{M}[j].e^{i.\frac{2\pi.j.ICTD}{N}}, \\ \hat{R}[j] = c_2[j].\hat{M}[j] \end{cases} \tag{27}$$

where ICTD is the time difference between L and R in number of samples for the current frame and N is the length of the Fourier transform (here N=160).

Figure 9:
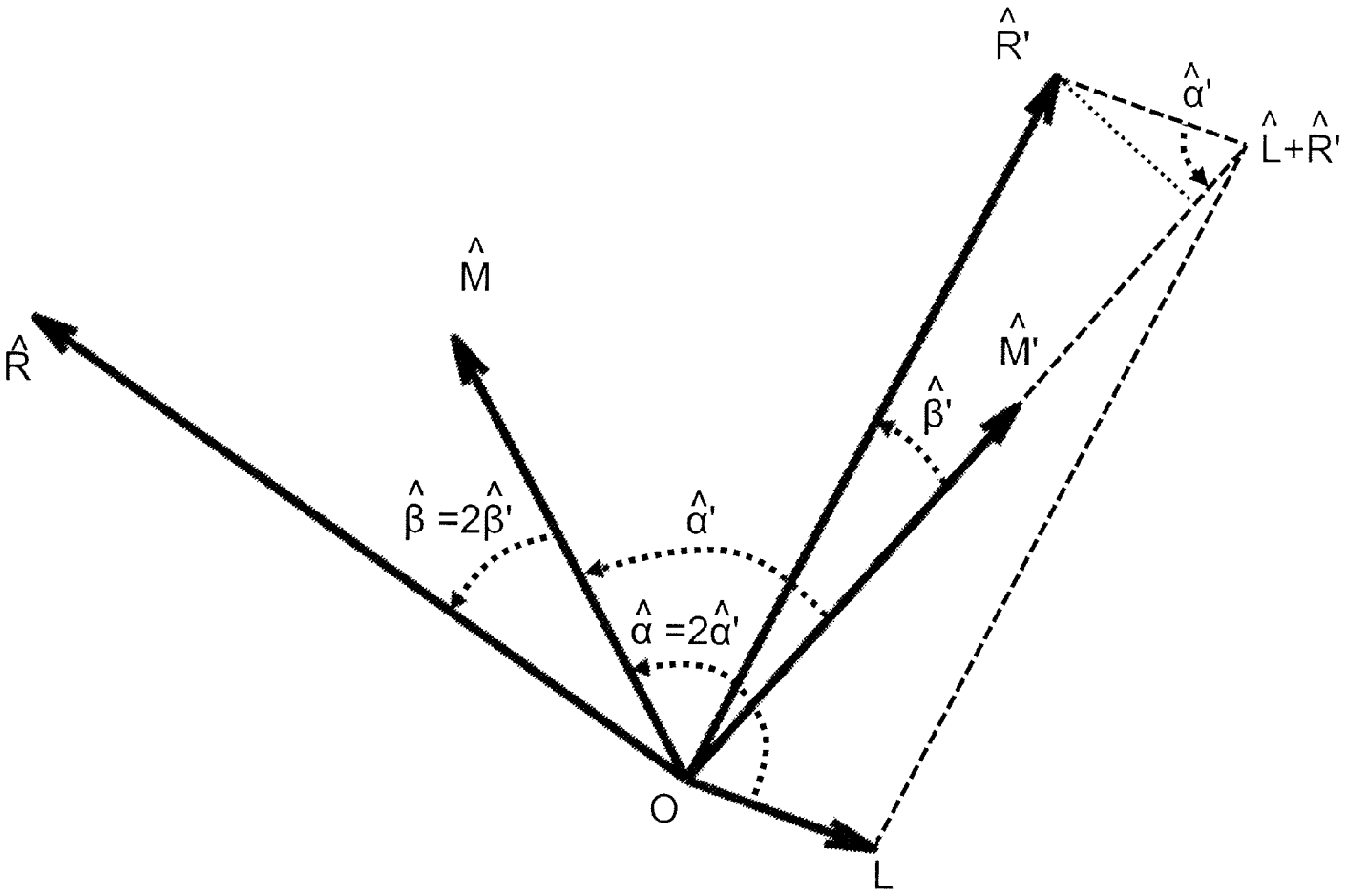
FIG. 9 illustrates a mode of calculation, according to one embodiment of the invention, of the phase differences for the synthesis of the stereo signals in the decoder, using the spatialization information.

If the decoder operates at 64+16 kbit/s, the decoder additionally receives the information coded in the second stereo improvement layer, which allows the parameters $\hat{\theta}[j]$ to be decoded for the lines of index j=2 to 9 and the parameters $\hat{\alpha}[j]$ and $\hat{\beta}[j]$ to be deduced from these as explained now with reference to FIG. 9.

FIG. 9 is a geometric illustration of the phase differences (angles) decoded according to the invention. In order to simplify the presentation, it is considered here that the L channel is the secondary channel (Y) and the R channel is the primary channel (X). The inverse case may be readily deduced from the following developments. Thus: $\hat{\theta}[j]=\hat{\alpha}([j]\ j=2,\ldots,9$, and, in addition, the definition of the angles $\hat{\alpha}[j]$ and $\hat{\alpha}'[j]$ is found from the coder, with the only differences being the use here of the notation ^ to indicate decoded parameters.

The intermediate angle $\hat{\alpha}'[j]$ between $\hat{L}$ and $\hat{M}$ is deduced from the angle $\hat{\alpha}[j]$ via the relationship:

$$\hat{\alpha}'[j] = \frac{\hat{\alpha}[j]}{2}$$

The intermediate angle $\hat{\beta}'[j]$ is defined as the phase difference between M' and R' as follows:

$$\hat{\beta}'[j]=\angle(\hat{R}'[j]\cdot\hat{M}'[j]^*) \tag{28}$$

and the phase difference between M and R is defined by:

$$\beta[j]=\angle(R[j]\cdot M[j]^*) \tag{29}$$

It should be noted that, in the case in FIG. 9, it is assumed that the geometrical relationships defined in FIG. 5 for the coding are still valid, that the coding of M[j] is virtually perfect and that the angles $\alpha[j]$ are also coded very precisely. These assumptions are generally verified for the G.722 coding in the range of frequencies j=2, . . . , 9 and for a coding of $\alpha[j]$ with a reasonably fine quantization pitch. In the variant where the downmix is calculated by differentiating between the lines whose index is within the interval [2,9] or otherwise, this assumption is verified because the L and R channels are 'distorted' in amplitude, so that the amplitude ratio between L and R corresponds to the ratio $\hat{I}[j]$ used in the decoder.

In the opposite case, FIG. 9 would still remain valid, but with approximations on the fidelity of the reconstructed L and R channels, and in general a reduced quality of stereo synthesis.

As illustrated in FIG. 9, starting from the known values $|\hat{R}[j]|$, $|\hat{L}[j]|$ and $\hat{\alpha}'[j]$, the angle $\hat{\beta}'[j]$ may be deduced by projection of R' onto the straight line connecting 0 and L+R', where the trigonometric relationship:

$$|\hat{L}[j]|\cdot|\sin\hat{\beta}'[j]|=|R'[j]|\cdot|\sin\hat{\alpha}'[j]|=|\hat{R}[j]|\cdot|\sin\hat{\alpha}'[j]|$$

may be found.

Hence, the angle $\hat{\beta}'[j]$ may be found from the equation:

$$|\sin\hat{\beta}'[j]| = \frac{|\hat{R}[j]|}{|\hat{L}[j]|}\cdot|\sin\hat{\alpha}'[j]| \tag{30}$$

or $$\hat{\beta}'[j] = s.\arcsin\left(\frac{|\hat{R}[j]|}{|\hat{L}[j]|}\cdot|\sin\hat{\alpha}'[j]|\right)$$

where s=+1 or −1 such that the sign of $\hat{\beta}'[j]$ is opposite to that of $\hat{\alpha}'[j]$, or more precisely:

$$s = \begin{cases} -1 & \text{if } \hat{\beta}'[j].\hat{\alpha}'[j] \geq 0 \\ 1 & \text{if } \hat{\beta}'[j].\hat{\alpha}'[j] < 0 \end{cases} \tag{31}$$

The phase difference $\hat{\beta}[j]$ between the R channel and the signal M is deduced from the relationship:

$$\beta[j]=2\cdot\beta'[j] \tag{32}$$

Lastly, the R channel is reconstructed based on the formula:

$$\hat{R}[j]=c_2[j]\cdot\hat{M}[j]e^{i\cdot\hat{\beta}[j]} \tag{33}$$

The decoding (or 'estimation') of $\hat{\alpha}[j]$ and $\hat{L}[j]$ using $\hat{\theta}[j]=\hat{\beta}[j]$, in the case where the L channel is the primary channel (X) and the R channel is the secondary channel (Y), follows the same procedure and is not detailed here.

Thus at 64+16 kbit/s the stereo synthesis is carried out by the block 507 in FIG. 8 as follows for j=2, . . . , 9:

$$\begin{cases} \hat{L}[j] = c_1[j].\hat{M}[j]e^{i.\hat{\alpha}[j]}, \\ \hat{R}[j] = c_2[j].\hat{M}[j]e^{i.\hat{\beta}[j]} \end{cases} \tag{34}$$

and otherwise identical to the previous stereo synthesis for j=0, . . . , 80 outside of 2, . . . , 9.

The spectra $\hat{R}[j]$ and $\hat{L}[j]$ are subsequently converted into the time domain by inverse FFT, windowing, and overlap-add (blocks 508 to 513) in order to obtain the synthesized channels $\hat{R}(n)$ and $\hat{L}(n)$.

Thus, the method implemented in the decoding is represented for variant embodiments by flow diagrams illustrated with reference to the FIGS. 10*a* and 10*b*, assuming that a data rate of 64+16 kbit/s is available.

Figure 10A:
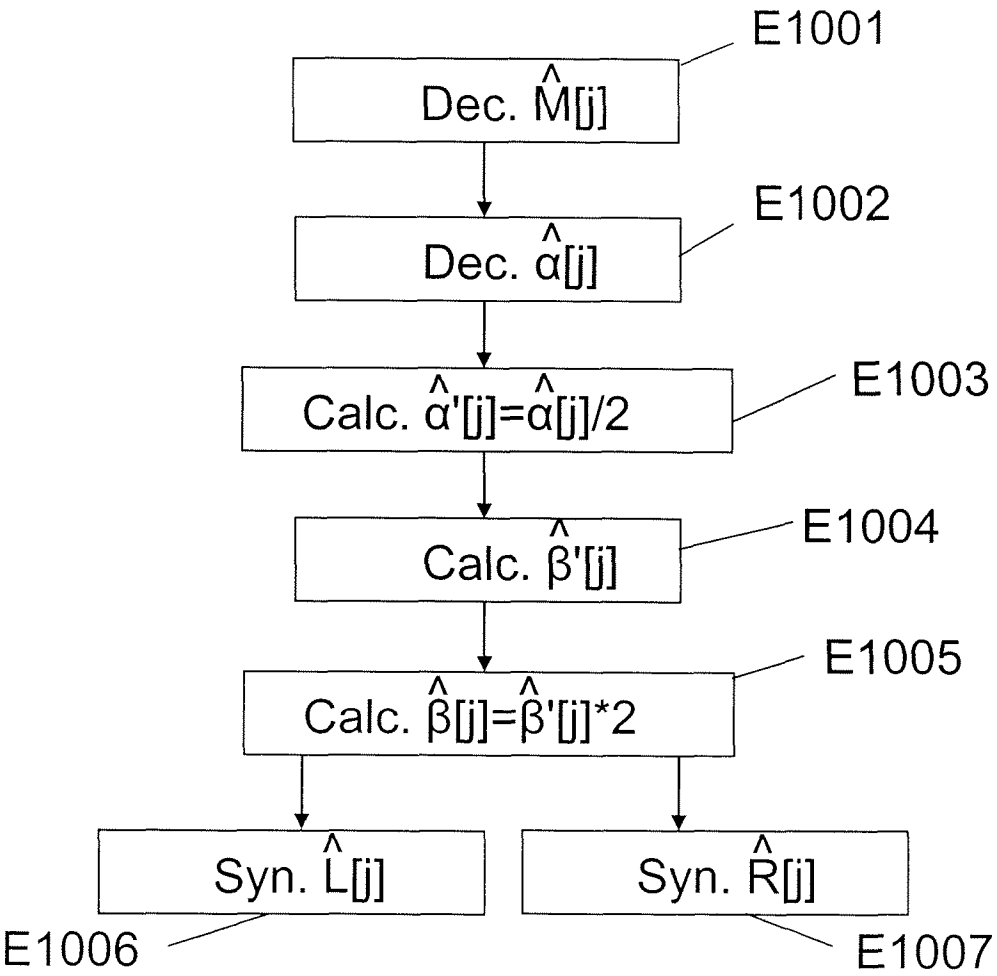
FIGS. 10*a* and 10*b* illustrate, in the form of flow diagrams, the steps of a decoding method according to variant embodiments of the invention.

As in the preceding detailed description associated with FIG. 9, the simplified case is first of all presented in FIG. 10*a*, where the L channel is the secondary channel (Y) and the R channel is the primary channel (X), and hence $\hat{\theta}[j]=\hat{\alpha}[j]$.

At the step E1001, the spectrum of the mono signal $\hat{M}[j]$ is decoded.

The angles $\hat{\alpha}[j]$ for the frequency coefficients j=2, . . . , 9 are decoded at the step E1002, using the second stereo extension layer. The angle α represents the phase difference between a predetermined first channel of the stereo channels, here the L channel and the mono signal.

The angles $\hat{\alpha}'[j]$ are subsequently calculated at the step E1003 from the decoded angles $\hat{\alpha}[j]$. The relationship is such that $\hat{\alpha}'[j]=\hat{\alpha}([j]/2$.

At the step E1004, an intermediate phase difference β' between the second channel of the modified or intermediate stereo signal, here R', and the intermediate mono signal M' is determined using the calculated phase difference α' and the information on the amplitude of the stereo channels decoded in the first extension layer, in the block 505 in FIG. 8.

The calculation is illustrated in FIG. 9; the angles $\hat{\beta}'[j]$ are thus determined according to the following equations:

$$\hat{\beta}'[j] = s.\arcsin\left(\frac{|\hat{R}[j]|}{|\hat{L}[j]|}\cdot|\sin\hat{\alpha}'[j]|\right) = s.\arcsin\left(\frac{|\hat{R}[j]|}{|\hat{L}[j]|}\cdot\frac{|\sin\hat{\alpha}[j]|}{2}\right) \tag{35}$$

At the step E1005, the phase difference β between the second R channel and the mono signal M is determined from the intermediate phase difference β'.

The angles $\hat{\beta}[j]$ are deduced using the following equation:

$$\hat{\beta}[j] = 2.\hat{\beta}'[j] = 2.s.\arcsin\left(\frac{|\hat{R}[j]|}{|\hat{L}[j]|}\cdot\left|\sin\frac{\hat{\alpha}[j]}{2}\right|\right)$$

and $$s = \begin{cases} -1 & \text{if } \hat{\beta}[j].\hat{\alpha}[j] \geq 0 \\ 1 & \text{if } \hat{\beta}[j].\hat{\alpha}[j] < 0 \end{cases}$$

Finally, at the steps E1006 and E1007, the synthesis of the stereo signals, by frequency coefficient, is carried out starting from the decoded mono signal and from the phase differences determined between the mono signal and the stereo channels.

The spectra $\hat{R}[j]$ and $\hat{L}[j]$ are thus calculated.

Figure 10B:
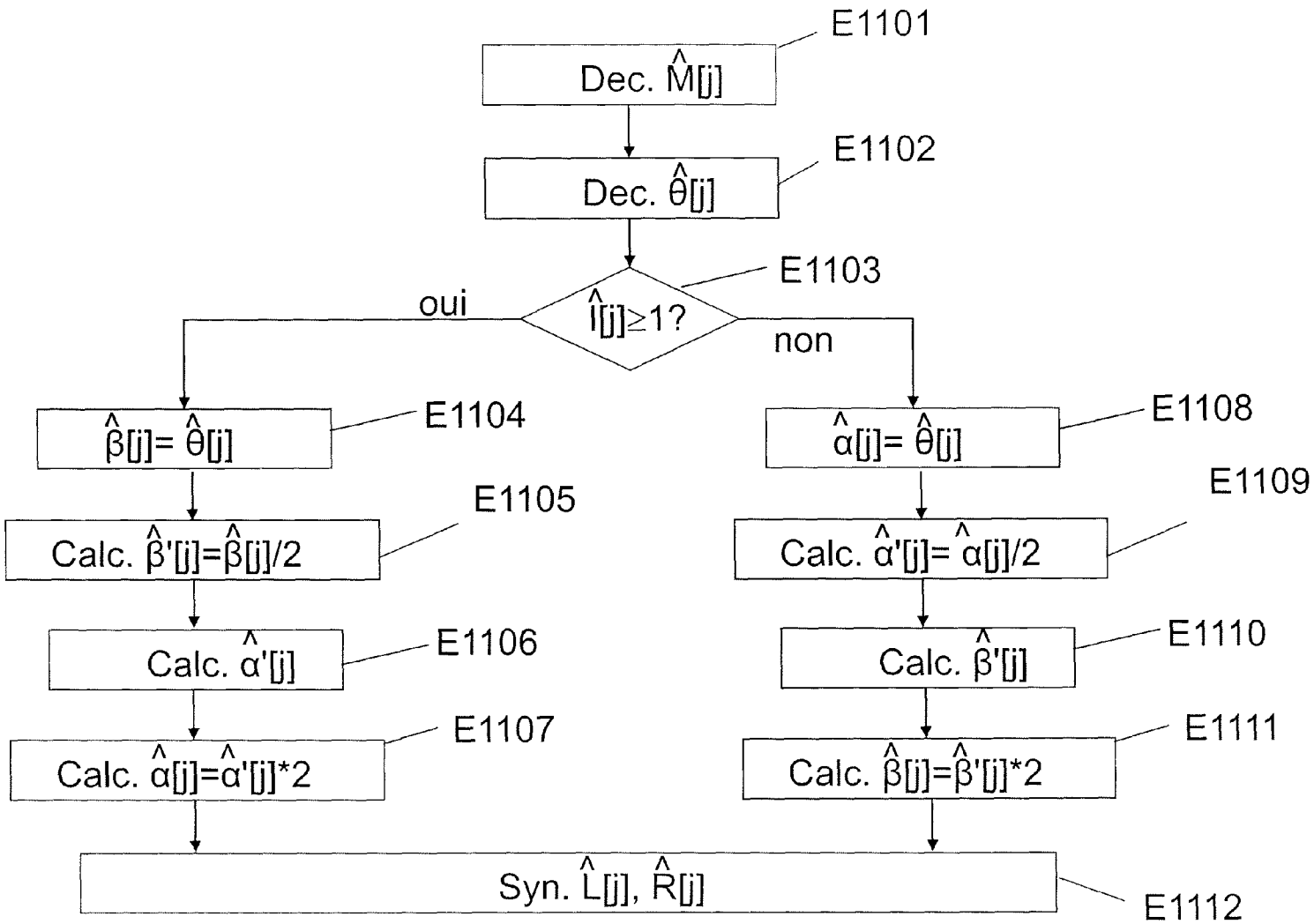

FIG. 10*b* presents the general case where the angle $\hat{\theta}[j]$ corresponds in an adaptive manner to the angle $\hat{\alpha}[j]$ or $\hat{\beta}[j]$.

At the step E1101, the spectrum of the mono signal $\hat{M}[j]$ is decoded.

The angles $\hat{\theta}[j]$ for the frequency coefficients j=2, . . . , 9 are decoded at the step E1102, using the second stereo extension layer. The angle $\hat{\theta}[j]$ represents the phase difference between a predetermined first channel of the stereo channels (here the secondary channel) and the mono signal.

The case where the L channel is primary or secondary is subsequently differentiated at the step E1103. The differentiation between secondary and primary channel is applied in order to identify which phase difference $\hat{\alpha}[j]$ or $\hat{\beta}[j]$ has been transmitted by the coder:

$$\begin{cases} \hat{\alpha}[j] = \hat{\theta}[j] & \text{if } \hat{I}[j] < 1 \\ \hat{\beta}[j] = \hat{\theta}[j] & \text{if } \hat{I}[j] \geq 1 \end{cases}$$

The following part of the description assumes that the L channel is secondary.

The angles $\hat{\alpha}'[j]$ are subsequently calculated at the step E1109 from the angles $\hat{\alpha}[j]$ decoded at the step E1108. The relationship is such that $\hat{\alpha}'[j]=\hat{\alpha}[j]/2$.

The other phase difference is deduced by exploiting the geometrical properties of the downmix used in the invention. As the downmix can be calculated by modifying either one of L or R in order to use a modified channel L' or R', it is assumed here that in the decoder the decoded mono signal has been obtained by modifying the primary channel X. Thus, the intermediate phase difference ($\alpha'$ or $\beta'$) between the secondary channel and the intermediate mono signal M' is defined as in FIG. 9; this phase difference may be determined using $\hat{\theta}'[j]$ and the information on the amplitude $\hat{I}[j]$ of the stereo channels decoded in the first extension layer, at the block 505 in FIG. 8.

The calculation is illustrated in FIG. 9 assuming that L is secondary and R primary, which is equivalent to determining the angles $\hat{\beta}'[j]$ starting from $\hat{\alpha}'[j]$ (block E1110). These angles are calculated according to the following equation:

$$\hat{\beta}'[j] = s.\arcsin\left(\frac{|\hat{R}[j]|}{|\hat{L}[j]|}\cdot|\sin\hat{\alpha}'[j]|\right) = s.\arcsin\left(\frac{|\hat{R}[j]|}{|\hat{L}[j]|}\cdot\frac{|\sin\hat{\alpha}[j]|}{2}\right) \quad (35)$$

At the step E1111, the phase difference $\beta$ between the second R channel and the mono signal M is determined from the intermediate phase difference $\beta'$.

The angles $\hat{\beta}[j]$ are deduced by the following equation:

$$\hat{\beta}[j] = 2.\hat{\beta}'[j] = 2.s.\arcsin\left(\frac{|\hat{R}[j]|}{|\hat{L}[j]|}\cdot\left|\sin\frac{\hat{\alpha}[j]}{2}\right|\right)$$

and $$s = \begin{cases} -1 & \text{if } \hat{\beta}[j].\hat{\alpha}[j] \geq 0 \\ 1 & \text{if } \hat{\beta}[j].\hat{\alpha}[j] < 0 \end{cases}$$

Lastly, at the step E1112, the synthesis of the stereo signals, by frequency coefficient, is carried out starting from the decoded mono signal and from the phase differences determined between the mono signal and the stereo channels.

The spectra $\hat{R}[j]$ and $\hat{L}[j]$ are thus calculated and subsequently converted into the time domain by inverse FFT, windowing, and overlap-add (blocks 508 to 513) in order to obtain the synthesized channels $\hat{R}(n)$ and $\hat{L}(n)$.

It will also be noted that the implementation of the decoder presented previously was based on a downmix using a reduction of the phase difference ICPD by a factor of ½. When the downmix uses a different reduction factor (<1), for example a value of ¾, the principle of the decoding of the stereo parameters will remain unchanged. In the decoder, the second improvement layer will comprise the phase difference ($\theta[j]$ or $\alpha_{buf}[j]$) defined between the mono signal and a predetermined first stereo channel. The decoder will be able to deduce the phase difference between the mono signal and the second stereo channel using this information.

The coder presented with reference to FIG. 3 and the decoder presented with reference to FIG. 8 have been described in the case of the particular application of hierarchical coding and decoding. The invention may also be applied in the case where the spatialization information is transmitted and received in the decoder in the same coding layer and for the same data rate.

Moreover, the invention has been described based on a decomposition of the stereo channels by discrete Fourier transform. The invention is also applicable to other complex representations, such as for example the MCLT (Modulated Complex Lapped Transform) decomposition combining a modified discrete cosine transform (MDCT) and modified discrete sine transform (MDST), and also to the case of filter banks of the Pseudo-Quadrature Mirror Filter (PQMF) type. Thus, the term "frequency coefficient" used in the detailed description may be extended to the notion of "sub-band" or of "frequency band", without changing the nature of the invention.

The coders and decoders such as described with reference to FIGS. 3 and 8 may be integrated into multimedia equipment of the home decoder, "set top box" or audio or video content reader type. They may also be integrated into communications equipment of the mobile telephone or communications gateway type.

Figure 11A:
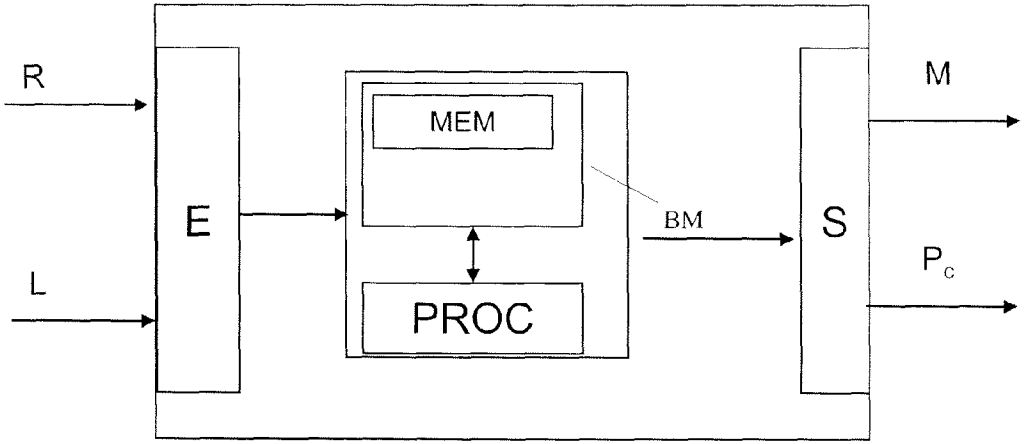
FIGS. 11*a* and 11*b* respectively illustrate one hardware example of a unit of equipment incorporating a coder and a decoder capable of implementing the coding method and the decoding method according to one embodiment of the invention.

FIG. 11*a* shows one exemplary embodiment of such equipment into which a coder according to the invention is integrated. This device comprises a processor PROC cooperating with a memory block BM comprising a volatile and/or non-volatile memory MEM.

The memory block may advantageously comprise a computer program comprising code instructions for the implementation of the steps of the coding method in the sense of the invention, when these instructions are executed by the processor PROC, and notably the steps for coding a mono signal coming from a channel reduction processing applied to the stereo signal and for coding spatialization information of the stereo signal. During these steps, the channel reduction processing comprises the determination, for a predetermined set of frequency sub-bands, of a phase difference between two stereo channels, the obtaining of an intermediate channel by rotation of a predetermined first channel of the stereo signal, through an angle obtained by reduction of said phase difference, the determination of the phase of the mono signal starting from the phase of the signal summing the intermediate channel and the second stereo signal and from a phase difference between, on the one hand, the signal summing the intermediate channel and the second channel and, on the other hand, the second channel of the stereo signal.

The program can comprise the steps implemented for coding the information adapted to this processing.

Typically, the descriptions in FIGS. 3, 4*a*, 4*b* and 5 use the steps of an algorithm of such a computer program. The computer program may also be stored on a memory medium readable by a reader of the device or equipment or downloadable into the memory space of the latter.

Such a unit of equipment or coder comprises an input module capable of receiving a stereo signal comprising the R and L (for right and left) channels, either via a communications network, or by reading a content stored on a storage medium. This multimedia equipment may also comprise means for capturing such a stereo signal.

The device comprises an output module capable of transmitting the coded spatial information parameters $P_c$ and a mono signal M coming from the coding of the stereo signal.

Figure 11B:
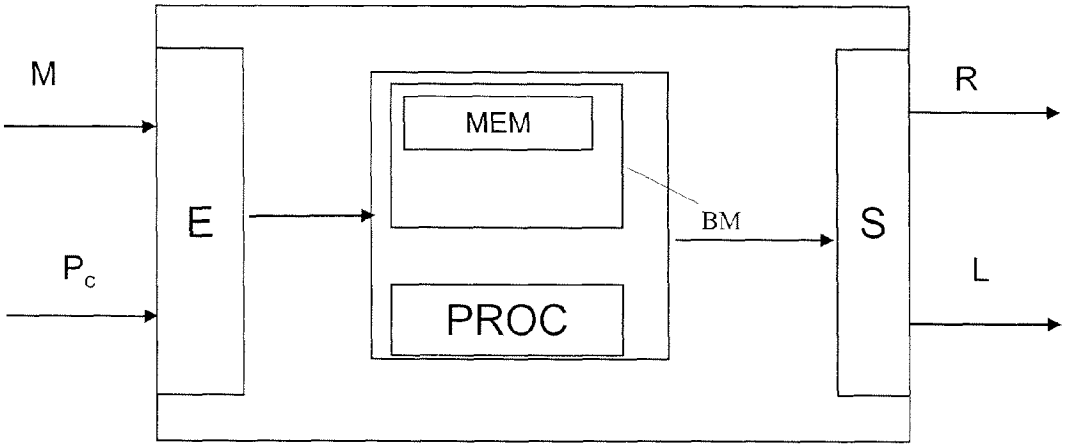

In the same manner, FIG. 11*b* illustrates an example of multimedia equipment or a decoding device comprising a decoder according to the invention.

This device comprises a processor PROC cooperating with a memory block BM comprising a volatile and/or non-volatile memory MEM.

The memory block may advantageously comprise a computer program comprising code instructions for the implementation of the steps of the decoding method in the sense of the invention, when these instructions are executed by the processor PROC, and notably the steps for decoding of a received mono signal, coming from a channel reduction processing applied to the original stereo signal and for decoding of spatialization information of the original stereo signal, the spatialization information comprising a first information on the amplitude of the stereo channels and a second information on the phase of the stereo channels, the second information comprising, by frequency sub-band, the phase difference defined between the mono signal and a predetermined first stereo channel. The decoding method comprises, based on the phase difference defined between the mono signal and a predetermined first stereo channel, the calculation of a phase difference between an intermediate mono channel and the predetermined first channel for a set of frequency sub-bands, the determination of an intermediate phase difference between the second channel of the modified stereo signal and an intermediate mono signal using the calculated phase difference and the decoded first information, the determination of the phase difference between the second channel and the mono signal from the intermediate phase difference, and the synthesis of the stereo signals, by frequency coefficient, starting from the decoded mono signal and from the phase differences determined between the mono signal and the stereo channels.

Typically, the description in FIGS. 8, 9 and 10 relates to the steps of an algorithm of such a computer program. The computer program can also be stored on a memory medium readable by a reader of the device or downloadable into the memory space of the equipment.

The device comprises an input module capable of receiving the coded spatial information parameters $P_c$ and a mono signal M coming for example from a communications network. These input signals may come from a read operation on a storage medium.

The device comprises an output module capable of transmitting a stereo signal, L and R, decoded by the decoding method implemented by the equipment.

This multimedia equipment may also comprise reproduction means of the loudspeaker type or means of communication capable of transmitting this stereo signal.

It goes without saying that such multimedia equipment can comprise both the coder and the decoder according to the invention, the input signal then being the original stereo signal and the output signal the decoded stereo signal.

The invention claimed is:

1. A method for parametric coding of a stereo digital audio signal comprising:

a step of coding a mono signal coming from a channel reduction processing applied to the stereo signal and coding information on spatialization of the stereo signal, wherein the channel reduction processing comprises the following steps:

determining, for a predetermined set of frequency sub-bands, a phase difference between two stereo channels;

obtaining an intermediate channel by rotation of a predetermined first channel of the stereo signal, through an angle obtained by reduction of said phase difference;

obtaining, by frequency band, an intermediate mono signal from said intermediate channel and from the second channel of the stereo signal;

determining the mono signal by rotation of said intermediate mono signal by the phase difference between the intermediate mono signal and the second channel of the stereo signal.

2. The method as claimed in claim 1, wherein the intermediate channel is obtained by rotation of the predetermined first channel by half of the determined phase difference.

3. The method as claimed in claim 1, wherein the spatialization information comprises first information on the amplitude of the stereo channels and second information on the phase of the stereo channels, the second information comprising, by frequency sub-band, the phase difference defined between the mono signal and a predetermined first stereo channel.

4. The method as claimed in claim 1, wherein the phase difference between the mono signal and the predetermined first stereo channel is a function of the phase difference between the intermediate mono signal and the second channel of the stereo signal.

5. The method as claimed in claim 1, wherein the predetermined first channel is the channel referred to as primary channel whose amplitude is the higher between the channels of the stereo signal.

6. The method as claimed in claim 1, wherein, for at least one predetermined set of frequency sub-bands, the predetermined first channel is the channel referred to as primary channel for which the amplitude of the locally decoded corresponding channel is the higher between the channels of the stereo signal.

7. The method as claimed in claim 6, wherein the amplitude of the mono signal is calculated as a function of amplitude values of the locally decoded stereo channels.

8. The method as claimed in claim 3, wherein the first information is coded by a first layer of coding and the second information is coded by a second layer of coding.

9. A method for parametric decoding of an original stereo digital audio signal having stereo channels, the method comprising:

a step of decoding a received mono signal, coming from a channel reduction processing applied to the original stereo signal and decoding spatialization information of the original stereo signal, wherein the spatialization information comprises first information on the amplitude of the stereo channels and second information on the phase of the stereo channels, the second information comprising, by frequency sub-band, the phase difference defined between the mono signal and a predetermined first stereo channel;

based on the phase difference defined between the mono signal and a predetermined first stereo channel, calculating a phase difference between an intermediate mono channel and the predetermined first channel for a set of frequency sub-bands;

determining an intermediate phase difference between the second channel of the modified stereo signal and an intermediate mono signal from the calculated phase difference and from the decoded first information;

determining the phase difference between the second channel and the mono signal from the intermediate phase difference;

synthesizing the stereo signals, per frequency coefficient, starting from the decoded mono signal and from the phase differences determined between the mono signal and the stereo channels.

10. The method as claimed in claim 9, wherein the first information is decoded by a first decoding layer and the second information is decoded by a second decoding layer.

11. The method as claimed in claim 9, wherein the predetermined first stereo channel is the channel referred to as primary channel whose amplitude is the higher between the channels of the stereo signal.

12. A parametric coder for a stereo digital audio signal, the coder comprising:

a channel reduction processing module, comprising:

means for determining, for a predetermined set of frequency sub-bands, a phase difference between a predetermined first channel and a second channel of the stereo signal;

means for obtaining an intermediate channel by rotation of the predetermined first channel of the stereo signal, through an angle obtained by reduction of said determined phase difference;

means for obtaining, by frequency band, an intermediate mono signal from said intermediate channel and from the second channel of the stereo signal; and means for determining the mono signal by rotation of said intermediate mono signal by the phase difference between the intermediate mono signal and the second channel of the stereo signal;

at least one module configured to code spatialization information of the stereo signal; and a module configured to code the mono signal coming from the channel reduction processing module applied to the stereo signal.

13. A parametric decoder for a digital audio signal of a stereo digital audio signal, the decoder comprising:

a module configured to decode a received mono signal, coming from a channel reduction processing applied to the original stereo signal;

modules for decoding spatialization information of the original stereo signal, wherein the spatialization information comprises a first information on the amplitude of the stereo channels and a second information on the phase of the stereo channels, the second information comprising, by frequency sub-band, the phase difference defined between the mono signal and a predetermined first stereo channel;

means for calculating a phase difference between an intermediate mono channel and the predetermined first channel, for a set of frequency sub-bands, from the phase difference defined between the mono signal and a predetermined first stereo channel;

means for determining an intermediate phase difference between the second channel of the modified stereo signal and an intermediate mono signal from the calculated phase difference and from the decoded first information;

means for determining the phase difference between the second channel and the mono signal from the intermediate phase difference; and means for synthesizing the stereo signals, by frequency sub-band, starting from the decoded mono signal and from the phase differences determined between the mono signal and the stereo channels.

14. A hardware computer-readable medium comprising a computer program stored thereon, which comprises code instructions for implementation of a method for parametric coding of a stereo digital audio signal when the instructions are executed by a processor, wherein the instructions comprise:

instructions that configure the processor to code a mono signal coming from a channel reduction processing applied to the stereo signal and code information on spatialization of the stereo signal, instructions that configure the processor to perform the channel reduction processing, which comprises the following steps:

determining, for a predetermined set of frequency sub-bands, a phase difference between two stereo channels;

obtaining an intermediate channel by rotation of a predetermined first channel of the stereo signal, through an angle obtained by reduction of said phase difference;

obtaining, by frequency band, an intermediate mono signal from said intermediate channel and from the second channel of the stereo signal; and determining the mono signal by rotation of said intermediate mono signal by the phase difference between the intermediate mono signal and the second channel of the stereo signal.

15. A hardware computer-readable medium comprising a computer program stored thereon, which comprises code instructions for implementation of a method for parametric decoding of an original stereo digital audio signal having stereo channels, when the instructions are executed by a processor, wherein the instructions comprise:

instructions that configure the processor to decode a received mono signal, coming from a channel reduction processing applied to the original stereo signal and decode spatialization information of the original stereo signal, wherein the spatialization information comprises first information on the amplitude of the stereo channels and second information on the phase of the stereo channels, the second information comprising, by frequency sub-band, the phase difference defined between the mono signal and a predetermined first stereo channel;

instructions that configure the processor to calculate, based on the phase difference defined between the mono signal and a predetermined first stereo channel, a phase difference between an intermediate mono channel and the predetermined first channel for a set of frequency sub-bands;

instructions that configure the processor to determine an intermediate phase difference between the second channel of the modified stereo signal and an intermediate mono signal from the calculated phase difference and from the decoded first information;

instructions that configure the processor to determine the phase difference between the second channel and the mono signal from the intermediate phase difference; and instructions that configure the processor to synthesize the stereo signals, per frequency coefficient, starting from the decoded mono signal and from the phase differences determined between the mono signal and the stereo channels.

* * * * *